US007310076B2

(12) United States Patent
Suzuki et al.

(10) Patent No.: US 7,310,076 B2
(45) Date of Patent: Dec. 18, 2007

(54) DISPLAY APPARATUS

(75) Inventors: Mutsumi Suzuki, Kodaira (JP); Masakazu Sagawa, Inagi (JP); Toshiaki Kusunoki, Tokorozawa (JP)

(73) Assignee: Hitachi, Ltd., Tokyo (JP)

( * ) Notice: Subject to any disclaimer, the term of this patent is extended or adjusted under 35 U.S.C. 154(b) by 475 days.

(21) Appl. No.: 10/773,365

(22) Filed: Feb. 9, 2004

(65) Prior Publication Data

US 2004/0164301 A1 Aug. 26, 2004

(30) Foreign Application Priority Data

Feb. 17, 2003 (JP) ..... P2003-037604
Dec. 12, 2003 (JP) ..... P2003-414111

(51) Int. Cl.
*G09G 3/30* (2006.01)

(52) U.S. Cl. ..... 345/76; 345/75.2; 345/82; 345/83; 345/94; 345/95; 315/169.1; 315/169.3

(58) Field of Classification Search ..... 345/53–55, 345/76–79, 97, 94, 96, 98, 100, 74, 75, 80–82, 345/204, 208–210, 58
See application file for complete search history.

(56) References Cited

U.S. PATENT DOCUMENTS 6,456,267 B1 * 9/2002 Sato et al. ..... 345/92

(Continued)

FOREIGN PATENT DOCUMENTS

JP 6-75536 8/1992

(Continued)

OTHER PUBLICATIONS

C. Hosokawa et al., "L2.3: Organic Multicolor EL Display with Fine Pixels", 1997 SID International Symposium Digest of Technical Papers (May 1997), pp. 1073-1076.

(Continued)

*Primary Examiner*—Richard Hjerpe
*Assistant Examiner*—Jennifer T Nguyen
(74) *Attorney, Agent, or Firm*—Reed Smith LLP; Stanley P. Fisher, Esq.; Juan Carlos A. Marquez, Esq.

(57) ABSTRACT

An display apparatus arranged in a matrix having plural luminance modulation elements for modulating or do not modulating luminance depending upon application of a voltage of positive or reverse polarity, having plural parallel scanning electrodes and plural parallel data electrodes, in which each luminance modulation element is disposed at an intersection between the scanning electrode and the data electrode, and having first driving means connected to the scanning electrodes and outputting scanning pulses, and second driving means connected to the data electrodes, wherein the scanning electrodes are grouped into those in a selected state applied with a scanning pulse and those other than described above in a non-selected state at a certain time point during the scanning period; the number of the scanning lines in the selected state is $n_1$; the scanning lines in the non-selected state are grouped into non-selected state scanning lines at a high impedance state and non-selected state scanning lines at a low impedance state, the high impedance non-selected state scanning lines has higher impedance than the scanning lines in the selected state, and the low impedance non-selected state scanning lines has lower impedance than the high impedance non-selected state scanning lines; and the number of the non-selected state scanning lines at the low impedance state is $n_1 \times 2$ or more.

24 Claims, 16 Drawing Sheets

U.S. PATENT DOCUMENTS

| | | | | |
|---|---|---|---|---|
| 6,756,958 | B2 * | 6/2004 | Furuhashi et al. | 345/95 |
| 6,873,309 | B2 * | 3/2005 | Suzuki et al. | 345/76 |
| 2002/0093469 | A1 | 7/2002 | Suzuki et al. | |

FOREIGN PATENT DOCUMENTS

| | | |
|---|---|---|
| JP | 2002-162927 | 11/2000 |

OTHER PUBLICATIONS

T. Shimoda et al., "26.2: Invited Paper: Current Status and Future of Light-Emitting Polymer Display Driven by Poly-Si TFT", 1999 SID International Symposium Digest of Technical Papers (May 1999), pp. 372-375.

R. Meyer, "6 Diagonal Microtips Fluorescent Display for T.V. Applications", Eurodisplay '90, 10th International Display Research Conference Proceedings, Berlin, (1990), pp. 374-377.

Nobuyoshi Koshida et al., "Cold Electron Emission from Electroluminescent Porons Silicon Diodes", Japanese Journal of Applied Physics, vol. 34, part 2, No. 6A (1995), pp. L705-L707.

Nobuyasu Negishi et al., "High Efficiency Electron-Emission in Pt/$SiO_x$/Si/Al Structure", Japanese Journal of Applied Physics, vol. 36, part 2, No. 7B (1997), pp. L939-L941.

Great Britain search report dated Jun. 4, 2004.

* cited by examiner

Prior Art FIG. 3
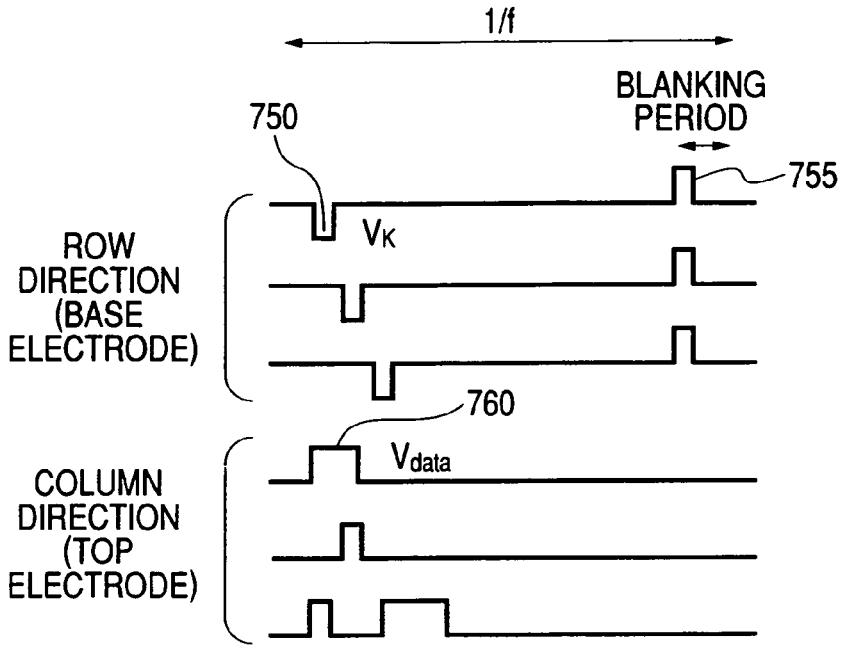
Prior Art FIG. 4
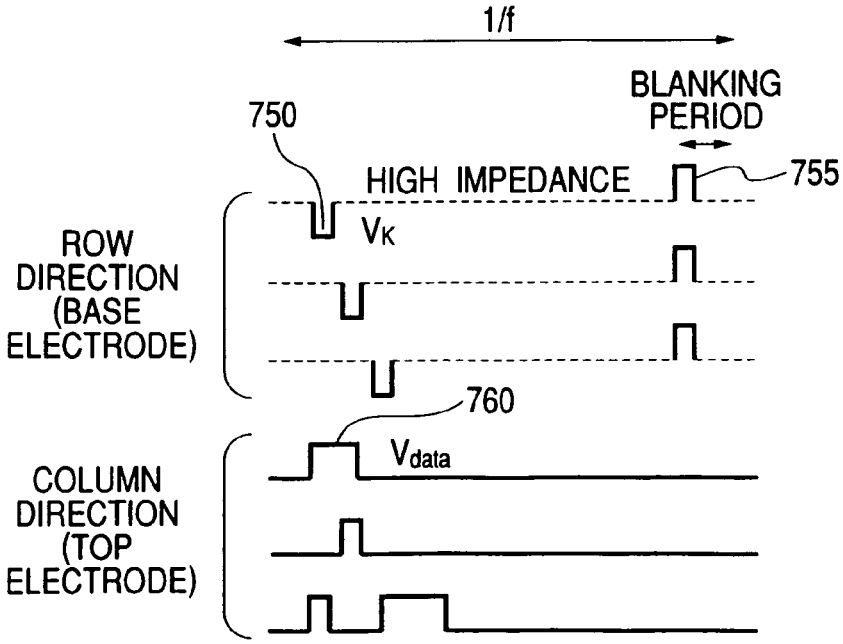

DISPLAY APPARATUS

BACKGROUND OF THE INVENTION

1. Field of the Invention

The present invention relates to an display apparatus and a method of driving the display apparatus and more particularly to a technique which is effective for application to an display apparatus in which a plurality of luminance modulation elements are arranged in a matrix.

2. Description of Relates Art

The display apparatuses in which a plurality of luminance modulation elements are arranged in a matrix include liquid crystal displays, field emission displays (FED), organic electroluminescence displays and the like. The luminance modulation element is adapted to change luminance depending on the applied voltage. In this specification, the luminance means transmittance or reflectance in the case of the liquid crystal display, and brightness of emission light in the case of displays using light emitting elements, such as the field emission display or the organic electroluminescence.

The displays described above have a merit capable of reducing the thickness of the display apparatus.

Accordingly, they are effective particularly as portable display apparatuses.

Those showing the background described above can include, for example, Patent Document 1, Non-Patent Document 1, Non-Patent Document 2, Non-Patent Document 3, Non-Patent Document 4, and Non-Patent Document 5. The documents will be described specifically later.

[Patent Document 1] JP-A No. 162927/2002

[Non-Patent Document 1] 1997 SID International Symposium Digest of Technical Papers, pp. 1073-1076 (issued, May 1997)

[Non-Patent Document 2] 1999 SID International Symposium Digest of Technical Papers, pp. 372-375 (issued, May 1999)

[Non-Patent Document 3] EURODISPLAY'90, 10th International Display Research Conference Proceedings (vde-verleg, Berlin, 1990), pp. 374-377

[Non-Patent Document 4] Japanese Journal of Applied Physics, vol. 34, part 2, No. 6A, pp. L705-L707 (1995)

[Non-Patent Document 5] Japanese Journal of Applied Physics, vol. 36, part 2, No. 7B, pp. L939-L941 (1997)

In a portable display apparatus, it is an important characteristic that the power consumption is small. Further, also in an installed type or a desk top type display apparatus, it is desirable that the power consumption is small with a view point of effective utilization of energy, or with a viewpoint of lowering the heat generation in the display apparatus.

However, in the prior art, large power in charge and discharge to and from the electric capacitance of the luminance modulation element caused increase in the power consumption.

In order to solve the problem, a method of decreasing the charge/discharge power by setting the non-selected electrode to high impedance in an display apparatus in which unipolar luminance modulation elements are arranged in a matrix has been disclosed, for example, in Patent Document 1 by the present applicant.

According to this method, the non-selected scanning line is set to a higher impedance state than the selected scanning line to decrease the load capacitance of the data line circuit substantially smaller thereby decreasing the charge/discharge power. On the other hand, in this method, since the potential on the electrode at the high impedance state is in a floating state, the potential is not constant. That is, an accidental voltage (induced voltage) is induced to the electrode at the high impedance state.

The example of disclosure described above discloses an image display method in which the induced voltage less tends to give an effect on the displayed image by combination of luminance modulation characteristics of unipolar luminance modulation elements, based on that the induced voltage tends to have a specified polarity.

However, since the potential of the electrode in the high impedance state is indefinite in view of principle, an accidental voltage is sometimes induced thereby possibly giving an effect on the display state.

In view of the problem, it has been disclosed a method of controlling the polarity of the induced voltage by setting only the scanning line adjacent with the selected scanning line to a low impedance state thereby controlling the polarity of the induced voltage in Patent Document 1 by the present applicant.

However, since the electrode in the high impedance state is indefinite in view of the principle, an accidental voltage is sometimes induced even in a case of using the method disclosed in the known example described above to possibly give an undesired effect on the display state.

For describing the feature of the invention, description is to be made specifically for the subject of the driving method disclosed so far. Description is to be made to an example of using a thin-film electron emitter and a phosphor in combination as a luminance modulation element.

FIG. 2 is a view showing a schematic constitution of a matrix for luminance modulation elements.

A luminance modulation element 301 is formed at each intersection between row electrodes 310 and column electrodes 311.

While FIG. 2 shows an example of 3 rows×3 columns, the luminance modulation elements 301 are arranged actually by the number of pixels constituting a display apparatus or by the number of sub-pixels in the case of a color display apparatus.

That is, in a typical example, the number N of rows and the number M of columns are typically: N=hundreds to thousands of rows and M=hundreds to thousands of columns, respectively.

In the case of color image display, a combination of each of sub-pixels of red, blue and green forms one pixel. In the present specification, those corresponding to sub-pixels in a case of color image display may also sometimes be referred to as "pixels". Alternatively, pixels in the case of monochrome display and sub-pixels in the case of color display are sometimes collectively referred to as "dot".

FIG. 3 is a timing chart for explaining an conventional driving method of an display apparatus. A negative pulse at an amplitude ($V_k$) (scanning pulse 750) is applied to one of row electrodes 310 (selected row electrode) from a row electrode driving circuit 41 and, at the same time, a positive pulse at an amplitude $V_{data}$ (data pulse 760) is applied to some of column electrodes 311 (selected column electrodes) from a column electrode driving circuit 42.

Since a voltage sufficient to emit light is applied to the luminance modulation element 301 on which two pulses are superimposed, the element emits light.

Since no sufficient voltage is applied to the luminance modulation element 301 not applied with the positive pulse with an amplitude ($V_{data}$), it does not emit light.

The row electrode 310 to be selected, that is, the row electrode 310 applied with the scanning pulse is selected successively and the data pulse applied to the column electrode 311 is also changed corresponding to the line.

When all the lines are thus scanned in a 1-field period, images corresponding to arbitrary images can be displayed.

In the matrix type display apparatus, a dissipation power consumption in the driving circuit causes a problem. The dissipation power consumption is a power consumed for charging and discharging electric charges to and from a capacitance of a driven element. The dissipation power does not contribute to light emission.

Capacitance per one luminance modulation element 301 is assumed as $C_e$. As can be seen from FIG. 2, a load capacitance of $NC_e$ is connected to each column electrode driving circuit 42. Accordingly, in a case of applying data pulses to the luminance modulation elements by the number of m per one line, a load capacitance of $mNC_e$ is connected in the column electrode driving circuit 42 in total. The electric power for charging and discharging to and from the load capacitance is the dissipation power consumption described above.

Assuming the number of refreshing screen for one sec (field frequency) as f, the dissipation power in the column electrode driving circuit 42 ($P_{data}$) is represented by the following equation (1):

$$P_{data}=f\cdot N^2\cdot m\cdot C_e\cdot(V_{data})^2 \quad (1)$$

Then, it is considered for a case where scanning lines other than those scanning lines to be applied with scanning pulses (the latter is referred to as scanning lines in the selected state) are set to a floating state (FIG. 4). In this state, since the load capacitance of the data line circuit is substantially decreased, the dissipation power in the column electrode driving circuit 42 is decreased. The scanning line in the non-selected state can be set to the floating state by setting the scanning line in the non-selected state to a high impedance state. The method of decreasing the dissipation power by the method described above is disclosed, for example, in the Patent Document 1 by the present applicant.

The load capacitance in the entire data line circuit in this case is represented by the following equation (2):

$$C_{col}(m)=\left\{m+\frac{m(M-m)(N-1)}{M}\right\}C_e \quad (2)$$

It takes a maximum value at m=M/2. In the driving method of connecting the scanning line in the non-selected state to a low impedance, the load capacitance of the data line takes a maximum value at m=M and, compared with this maximum value, the maximum value in the driving method of setting the scanning line in the non-selected state to the high impedance state is decreased to ¼. On the other hand, since setting the non-selected scanning lines to the floating state makes the potential of the scanning lines unstable, it may possibly gives an effect on displayed images. However, as disclosed in the Patent Document 1 by the present applicant, the polarity of the voltage induced to the non-selected scanning line induces a potential in a specified direction. That is, the voltage $V_{F,scan}$ induced to the non-selected scanning line is represented by the following equation (3).

$$V_{F,scan}=(m/M)V_{data}=xV_{data} \quad (3)$$

where x=m/M is a ratio for the number of luminance modulation elements in the ON state in one line and it is called as a lighting ratio. $V_{data}$ represents an amplitude voltage for the data pulse. The lighting ratio x is positive or zero. Accordingly, when $V_{data}$ is a positive voltage as shown in the driving waveform in FIG. 4, the induced voltage $V_{F,scan}$ is positive or zero. In FIG. 4, since the luminance is modulated when a negative voltage is applied to the scanning line, the induced voltage has a polarity which does not cause the luminance modulation. Accordingly, it is possible to decrease the effect of the induced voltage on the display images sufficiently by using unipolar luminance modulation elements and connecting them in the direction of not modulating the luminance by the polarity of the induced voltage.

The "unipolar" luminance modulation element is to be described.

An element that does not emit light when applied with a voltage of reverse polarity, that is, an element not taking the selected state for the luminance modulation state is referred to as "unipolar luminance modulation element" in a more general expression, in the sense that the luminance is modulated only by applying a voltage of the positive polarity. On the contrary, an element that emits light or takes the selected state for the luminance modulation state also when the voltage at reverse polarity is applied is referred to as "bipolar luminance modulation element" in the sense that the luminance is modulated by applying a voltage of either of two polarities: positive and negative polarities.

As apparent from the foregoing description, "not modulating luminance at reverse polarity" may be at such an extent as not causing crosstalk of displayed images even when a voltage at the reverse polarity is applied. Even for an element that modulates the luminance slightly upon application of a voltage at reverse polarity, if the state of luminance modulation is within a range not visible to human eyes or not causing a problem as the display apparatus, this can be regarded substantially as "not modulating luminance". The element can therefore be regarded as "unipolar" luminance modulation element.

The unipolar luminance modulation element is to be described further in details. Luminance modulation elements having luminance-voltage characteristics shown in FIG. 5A and FIG. 5B are to be considered. Description is to be made to an example of a light emission element as the luminance modulation element. In FIGS. 5A and 5B, the ordinate indicates the luminance, that is, brightness in the case of the light emitting element, while the abscissa indicates a voltage applied to the luminance modulation element. In the characteristics shown in FIG. 5A, when a voltage at positive polarity is applied, the luminance increases, whereas when a voltage at negative polarity is applied, the luminance is substantially zero. That is, the luminance modulation element having the characteristics shown in FIG. 5A is unipolar. On the other hand, in FIG. 5B, the luminance changes also in a case of applying a voltage at negative polarity. That is, the luminance modulation element having the characteristics shown in FIG. 5B is bipolar.

Considered is a case of constituting a matrix: N rows×M columns with luminance modulation elements and applying the driving voltage shown in FIG. 4. A scanning pulse at a negative voltage $V_k$ is applied to the selected line to render it into a "half-selected" state. A data pulse at a positive voltage $V_{data}$ is applied to the data lines for the luminance modulation elements which are intended to be lighted among the selected line. Accordingly, a voltage: $V_{data}-V_k=|V_{data}|+|V_k|$ is applied to the luminance modulation elements at the intersections between the selected scanning line and the selected data lines, by which the luminance modulation elements emit light (point C in the figure).

In this case, a voltage: $V_{F,scan}$ represented by the equation (3) is induced to the scanning line in the non-selected state. Accordingly, a voltage: $-V_{F,scan}$ is applied to the luminance modulation elements at the intersections between the non-selected scanning line and the non-selected data lines (point D in the figure). In a case of the bipolar luminance modulation element of FIG. 5B, it slightly emits light by the induced voltage: $V_{F,scan}$ (point D in the figure). That is, not-intended luminance modulation element emits light. Accordingly, this disturbs displayed images. This is a problem in a case where the non-selected scanning line is set to high impedance.

The problem can be overcome by using the unipolar luminance modulation element. In a case of the unipolar luminance modulation element shown in FIG. 5A, it does not emit light even when $-V_{F,scan}$ is applied (point D in the figure). Accordingly, displayed image is not disturbed even when the non-selected scanning line is set to high impedance.

In the foregoings, description has been made to a case that the scanning pulse is a negative voltage and the data pulse is a positive voltage. It will be apparent that the situation is quite identical in a case where the scanning pulse is a positive voltage and the data pulse is a negative voltage. The equation (3) is valid also in this case, in which the voltage $V_{F,scan}$ induced to the scanning electrode is a negative voltage. Since this is at a polarity reverse to the luminance modulation element, no erroneous displayed image occurs by using the unipolar luminance modulation element as described above.

Examples of the bipolar luminance modulation element can include liquid crystal elements and thin film inorganic electroluminescence elements. The unipolar luminance modulation element can include, for example, an organic electroluminescence elements or electron emitting elements in combination with phosphors.

The organic electroluminescence element is also referred to as an organic light emitting diode, which has a diode characteristic of emitting light upon application of a forward voltage but not emitting light upon application of a voltage at reverse polarity. The organic electroluminescence element is described, for example, in Non-Patent Document 1. The polymer type organic electroluminescence element is described in Non-Patent Document 2.

An example of the luminance modulation element comprising a phosphor and an electron emitting element in combination is described, for example, in Non-Patent Document 3. In this example, the electron emitting element comprises an electron emitting emitter-tip and a gate electrode for applying an electric field to the emitter-tip. When a voltage positive to the emitter-tip is applied to the gate electrode, electrons can be emitted from the emitter-tip to emit light from the phosphor but the electrons are not emitted in a case of applying a negative voltage. That is, this is a unipolar luminance modulation element.

As described above, Patent Document 1 by the present applicant discloses that the effect of the induced voltage on the displayed images can be decreased by using the unipolar luminance modulation element.

However, a voltage of forward polarity of the luminance modulation element is sometimes induced to the scanning electrode in the floating state.

For example, when a scanning pulse is applied, a voltage of forward polarity is sometimes induced to the adjacent scanning electrode due to capacitive coupling between the adjacent scanning electrodes. The Patent Document 1 by the present applicant discloses a method of rendering only the scanning line adjacent with the scanning line to be applied with the scanning pulse to the low impedance state in order to prevent this.

However, in the method disclosed in the Patent Document 1, generation of the induced voltage of the forward polarity is not always inhibited. The present invention provides a method of minimizing the occurrence of the induced voltage of the forward polarity even in such a case, thereby minimizing the effect on the displayed images in a display apparatus constituted with unipolar luminance modulation elements.

SUMMARY OF THE INVENTION

The invention has been achieved in order to solve the foregoing problems in the prior art and the invention intends to provide a technique in the display apparatus capable of reducing the dissipation power in the luminance modulation element matrix.

The invention further intends to provide a technique of stabilizing the induced voltage on the electrode at the high impedance state further, thereby providing stable image display.

Further, a display apparatus using luminance modulation elements each comprising an electron emitting element and a phosphor in combination involves a problem that abnormal discharge tends to occur by a high voltage applied to the phosphor in a case where electrodes in the floating state are present.

Among inventions disclosed in the present application, typical inventions are to be briefly described below.

The invention provides an display apparatus having plural luminance modulation elements that modulate luminance upon application of a voltage of positive polarity and do not modulate luminance upon application of a voltage of reverse polarity, having plural scanning electrodes parallel with each other and plural data electrodes parallel with each other, in which each of the luminance modulation elements is disposed at an intersection between the scanning electrode and the data electrode, and having first driving means connected to the plural scanning electrodes and outputting scanning pulses, and second driving means connected to the plural data electrodes, wherein the scanning electrodes are grouped into those in a selected state applied with a scanning pulse and those other than described above in a non-selected state at a certain time point during the scanning period, the number of the scanning lines in the selected state is $n_1$, the scanning lines in the non-selected state are grouped into non-selected state scanning lines at a high impedance state and non-selected state scanning lines at a low impedance state, the non-selected state scanning lines at the high impedance state are at a higher impedance state than the scanning lines in the selected state, and the non-selected state scanning lines at the low impedance state is in a lower impedance state than the non-selected state scanning lines at the high impedance state, and the number of the non-selected state scanning lines at the low impedance state is $n_1 \times 2$ or more.

That is, this constitution can be described using formulae as below:

$$Z(SEL)<Z(NS, HZ), \text{ and } Z(NS, LZ)<Z(NS, HZ), \text{ and } N(NS, LZ) \geqq 2 \times N(SEL),$$

where

Z(SEL) represents the impedance for the scanning lines in the selected state,

Z(NS, HZ) represents the impedance in the non-selected state at a high impedance state, Z(NS, LZ) represents the impedance in the non-selected state at a low impedance state, N(SEL) represents the number of scanning lines in the selected state, N(NS, HZ) represents the number of scanning lines in the non-selected state at a high impedance state, and N(NS, LZ) represents the number of scanning lines in the non-selected state at a low impedance state.

The invention further provides an display apparatus having plural luminance modulation elements that modulate luminance upon application of a voltage of positive polarity and do not modulate luminance upon application of a voltage of reverse polarity, having plural scanning electrodes parallel with each other and plural data electrodes parallel with each other, and having first driving means connected to the plural scanning electrodes and outputting scanning pulses, and second driving means connected to the plural data electrodes, wherein the scanning electrodes are set to at least three states, namely, a selected state applied with a scanning pulse, a non-selected state at a high impedance state and a non-selected state at a low impedance state, the non-selected state scanning lines at the low impedance state is at a lower impedance state than the non-selected state scanning lines at the high impedance state, and the non-selected state at the low impedance state and the non-selected state at the high impedance state are repeated alternately.

The invention further provides an display apparatus having plural luminance modulation elements that modulate luminance upon application of a voltage of positive polarity and do not modulate luminance upon application of a voltage of reverse polarity, having plural scanning electrodes parallel with each other and plural data electrodes parallel with each other, and having first driving means connected to the plural scanning electrodes and outputting scanning pulses, and second driving means connected to the plural data electrodes, wherein the first driving means take at least three states, namely, a selected state of applying scanning pulses, a non-selected state at a high impedance state and a non-selected state at a low impedance state, the output impedance when outputting the non-selected state at the low impedance state is at a lower impedance than the output impedance when outputting the non-selected state at the high impedance state, and the non-selected state at the low impedance state and the non-selected state at the high impedance state are repeated alternately.

The invention further provides an display apparatus having plural luminance modulation elements each comprising a combination of an electron emitting element and a phosphor, and having first driving means connected to the plural scanning electrodes and outputting scanning pulses, and second driving means connected to the plural data electrodes, wherein the scanning electrodes take at least three states namely, a selected state applied with the scanning pulse, a non-selected state at a high impedance state, and a non-selected state at a low impedance state, the non-selected state scanning line at the low impedance state is in a lower impedance state than the non-selected state scanning line at the high impedance state, and the non-selected state at the low impedance state and the non-selected state at the high impedance state are repeated alternately.

FIG. 6 shows a voltage waveform appearing during operation to a row electrode 310. FIG. 6 shows an observed waveform in a thin-film electron emitter matrix comprising row electrodes 310 by the number of 60 and column electrodes 311 by the number of 60. In the figure, a graduation in the horizontal direction is 2 ms and a graduation in the vertical direction is 2 V. A pulse of negative polarity (a in the figure) is a scanning pulse and a pulse of positive polarity on the right of the figure (b in the figure) is an reverse pulse. The low impedance state is set only when the two pulses are applied. Other periods than described above are at the high impedance state. Other pulses of positive polarity appearing in the figure (c in the figure) are at an induced potential induced during the period of the high impedance. Since these induced pulses are of the reverse polarity for the thin-film electron emitter to emit electrons as has been described above, electron emission does not occur. On the other hand, the period from just after the application of the scanning pulse to the application of the reverse pulse (d in the figure), a voltage of negative polarity is induced. This is a potential induced by the effect of the application of the scanning pulse of negative polarity to an adjacent row electrode 310.

As apparent from the figure, it can be seen that the induced voltage of forward polarity tends to last once it is induced.

Then, in the invention, the scanning line in the non-selected state is set to a non-selected voltage of the low impedance at appropriate timings, thereby preventing intermittent or continuous application of the induced voltage of forward polarity to the scanning line in the non-selected state. This can stabilize the displayed image.

As has been described above in the invention, the number of the non-selected scanning lines at the low impedance state increases. Accordingly, it may be a concern that the dissipation power increases. Then, the dissipation power in the display apparatus according to the invention is calculated.

A matrix display having the effective scanning lines by the number of N and data lines by the number of M is considered. It is assumed that, at a certain time point, the number of scanning lines applied with the scanning pulse is 1, and the number of the non-selected scanning lines at the low impedance state is $n_0-1$. The number of the effective scanning lines is obtained by dividing the number of the scanning electrodes $N_0$ by the number of scanning lines scanned simultaneously. For example, in a case where only one scanning line is scanned within, a certain time ("one-line-at-a-time driving method"), $N=N_0$. Further in a case of a driving method of vertically bisecting the screen and scanning each one scanning line in the upper half-region and the lower half-region simultaneously ("two-line-at-a-time driving method"), $N=N_0/2$.

FIG. 7 is an equivalent circuit diagram in this case. This is a figure showing an equivalent circuit in a case of selecting column electrodes 311 by the number of m and fixing the non-selected column electrodes 311 by the number of (M−m) to the ground potential.

As shown in FIG. 7, scanning lines by the number of $n_0$ of one selected scanning line and non-selected scanning lines by the number of $(n_0-1)$ in total are at a low impedance state and other scanning lines by the number of $(N-n_0)$ are at the floating state. The load capacitance for the entire selected column electrodes 311 by the number of m can be represented by the following equation (4):

$$C_{col}(m) = \left\{n_0 m + \frac{m(M-m)(N-n_0)}{M}\right\}C_e = NMC_e\{x(1-x+bx)\} \tag{4}$$

in which $b=n_0/N$ is obtained by dividing the number of scanning lines at the low impedance state by the number of effective scanning lines (to be referred to herein as low impedance ratio), and $x=m/M$ represents a ratio of lighted dots in one line (lighting ratio).

As described above, the dissipation power of the data lines is in proportion with the load capacitance of the data lines represented by the equation (4). Accordingly, the level of the dissipation power can be known by determining the value for the load capacitance of the data line.

FIG. 8 is a graph obtained by plotting the load capacitance of the data lines as a function of the lighting ratio. In the graph, it is calculated at N=500. These plots are calculated for the number of the low impedance scanning lines of $n_0$=1, 10, 50, 100.

As described above, the load capacitance of the data line changes along with the lighting ratio x. The maximum value regarding the lighting ratio of the load capacitance is represented by the following equation (5):

$$C_{col}(\max)=NMC_e/\{4(1-b)\} \quad (5)$$

Since $n_0$=1 corresponds to a case where only the selected scanning line is at the low impedance state, this corresponds to the conventional driving method. Taking notice on the increase in the load capacitance to the conventional driving method ($n_0$=1), it remains 2% increase at $n_0$=10 (low impedance ratio b=10/500). Also at $n_0$=50 (b=10%), increase in the load capacitance remains at 10%.

As described above, compared with a driving method of setting all the non-selected scanning lines to the non-selected potential at the low impedance (referred to as "fixed potential driving"), the dissipation power in the data line circuit is decreased to ¼ (=25%) in the driving method of setting all the non-selected scanning lines to the high impedance. Accordingly, when the low impedance ratio b is restricted to about 10%, the dissipation power of the data line circuits in the display apparatus of the invention remains 28% to the case of fixed potential driving, and stabilizing effect for the display image can be obtained without deteriorating the power reducing effect.

"Fixed potential" means herein "fixed potential", in contrast to the floating potential. That is, it means a state where the set value and the actual value of potential on the wiring are identical, that is, it is essentially at the low impedance state. In other words, it does not always means that the potential is constant at a level in view of time.

The foregoing and other objects, as well as novel features of the invention will become apparent by reading the descriptions of the present specification and appended drawings.

The effects obtained by typical examples among those described in the present application are to be described briefly as below.

According to display apparatus of the invention, it is possible to decrease the dissipation power along with charge and discharge for the capacitance component of the luminance modulation element and decrease the power consumption.

BRIEF DESCRIPTION OF THE DRAWINGS

FIG. 3 is a view for explaining an conventional method of driving an display apparatus using a matrix of luminance modulation elements;

FIG. 4 is a view for explaining an conventional method of driving an display apparatus using a matrix of luminance modulation elements;

DETAILED DESCRIPTION OF THE PREFERRED EMBODIMENTS

Figure 1:
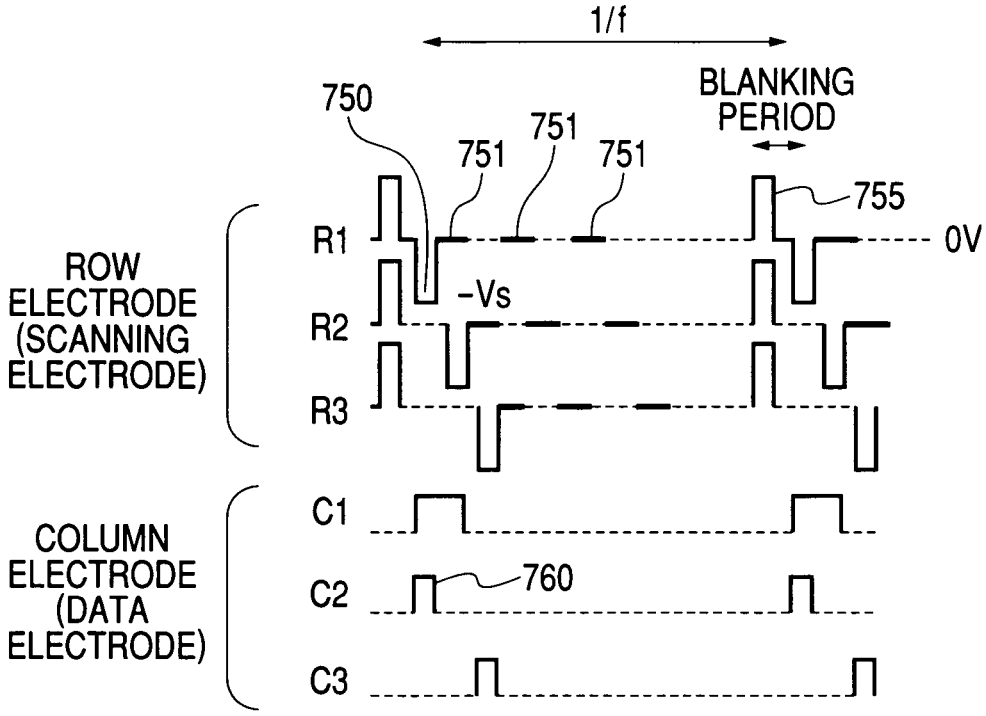
FIG. 1 is a view for explaining a method of driving an display apparatus according to the present invention.
Figure 2:
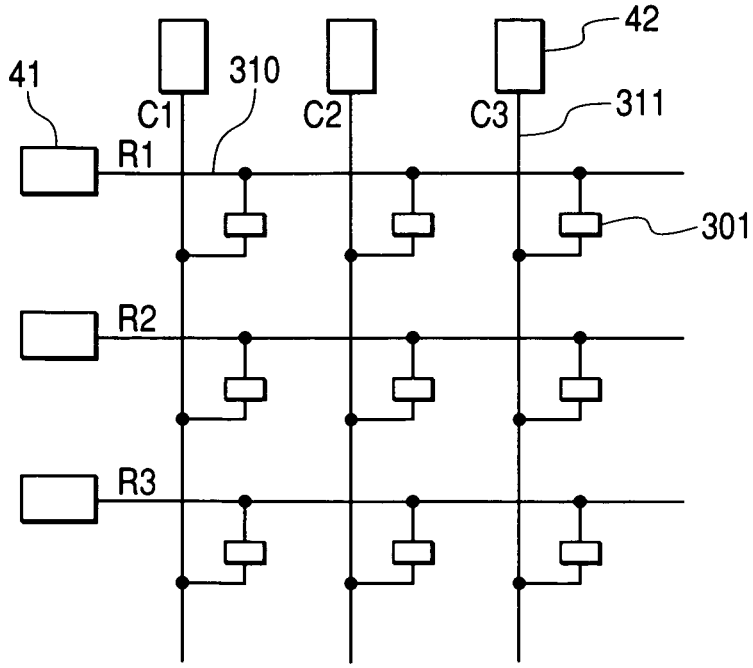
FIG. 2 is a view showing a schematic constitution of a matrix of luminance modulation elements.
Figure 5A:
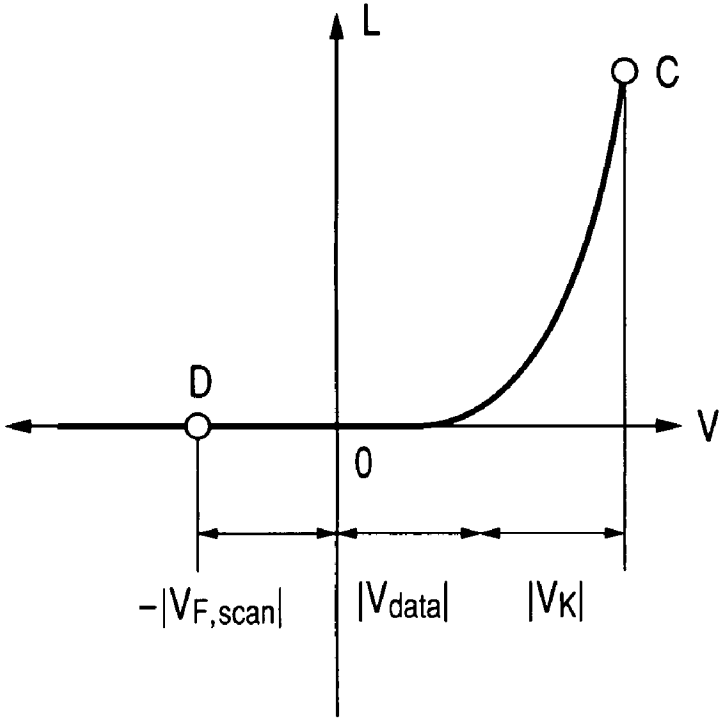
FIG. 5 is a view schematically showing the voltage dependence of luminance modulation characteristics of unipolar and bipolar luminance modulation elements.
Figure 5B:
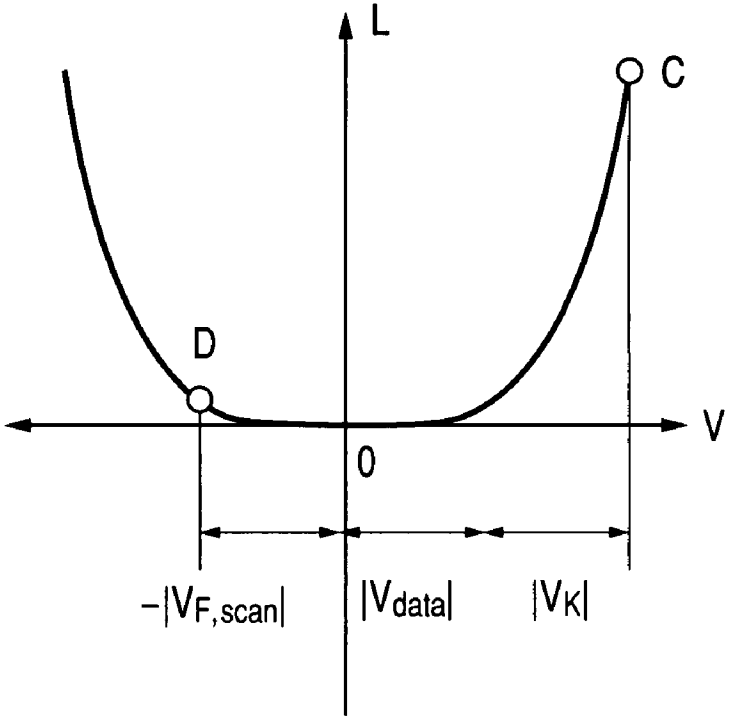
Figure 6:
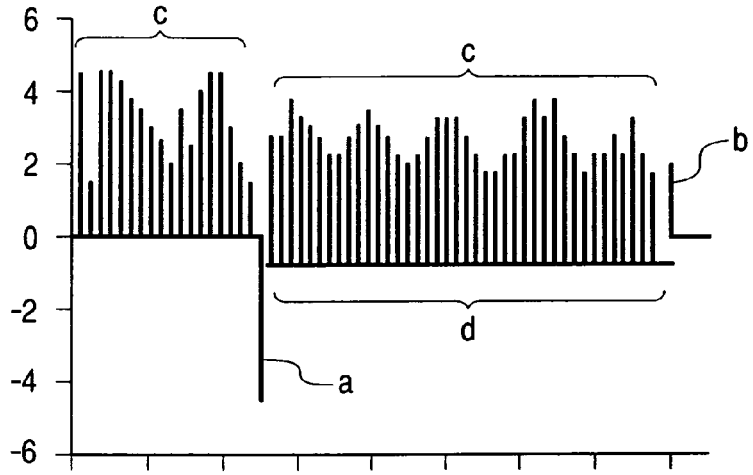
Prior Art FIG. 6
FIG. 6 is a view observing a voltage on a scanning electrode at a high impedance state in an conventional display apparatus.
Figure 7:
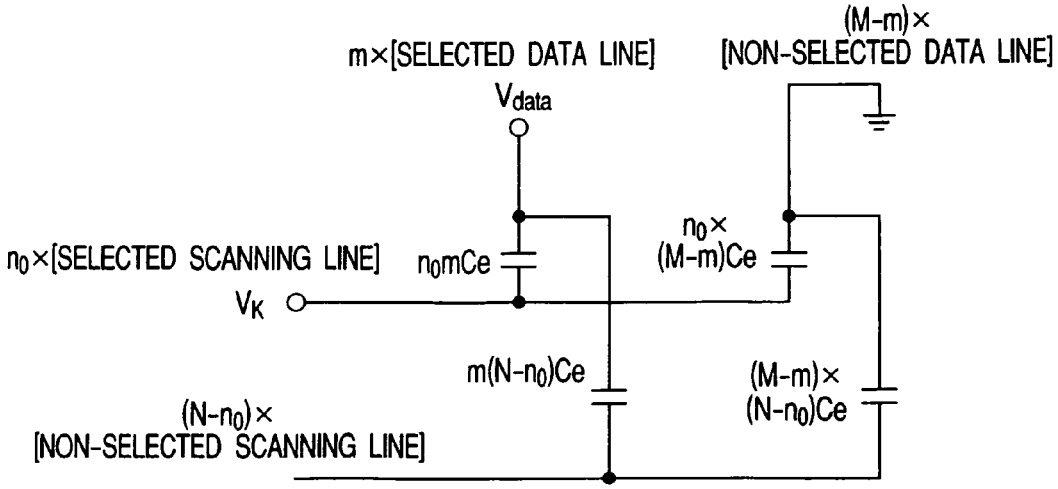
FIG. 7 is an equivalent circuit diagram for an display apparatus according to the invention.

Preferred embodiments of the present invention are to be described specifically with reference to the accompanying drawings. Throughout the drawings for explaining the preferred embodiments, components having identical function carry corresponding reference numerals, for which duplicated description will be omitted.

First Embodiment

An display apparatus of a first embodiment according to the invention is constituted by using a display panel in which each of luminance modulation elements for each dot is formed by the combination of a thin-film electron emitter matrix as an electron emitting emitter and a phosphor and connecting driving circuits to row electrodes and column electrodes of the display panel.

A thin-film electron emitter is an electron emitting element having a structure in which an electron acceleration layer such as an insulator is inserted between two electrodes (top electrodes and base electrode), in which hot electrons accelerated in an electron acceleration layer are emitted by way of an top electrode into vacuum. Known examples of the thin-film electron emitter can include, for example, MIM electron emitter comprising metal—insulator—metal, a ballistic electron surface emitting element using porous silicon or the like for an electron acceleration layer (for example, Non-Patent Document 4), and those using semiconductor-insulator laminate film for an electron acceleration layer (for example, Non-Patent Document 5).

An example using an MIM electron emitter is to be described.

The display panel comprises an electron emitter plate in which a matrix of thin-film electron emitters is formed and phosphor plate in which a phosphor pattern is formed.

Figure 9:
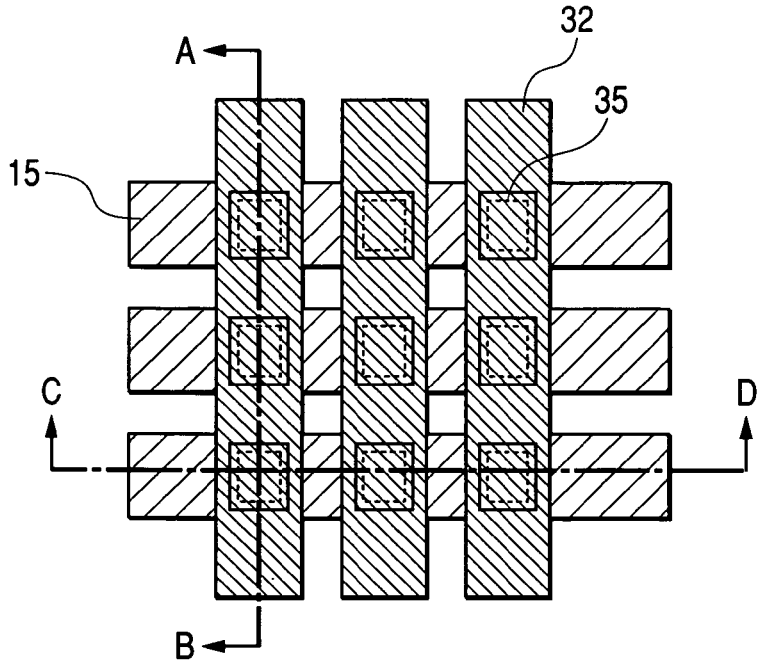
FIG. 9 is a plan view showing a constitution for a portion of a thin-film electron emitter matrix of an electron emitter plate in a first embodiment of the invention.
Figure 10:
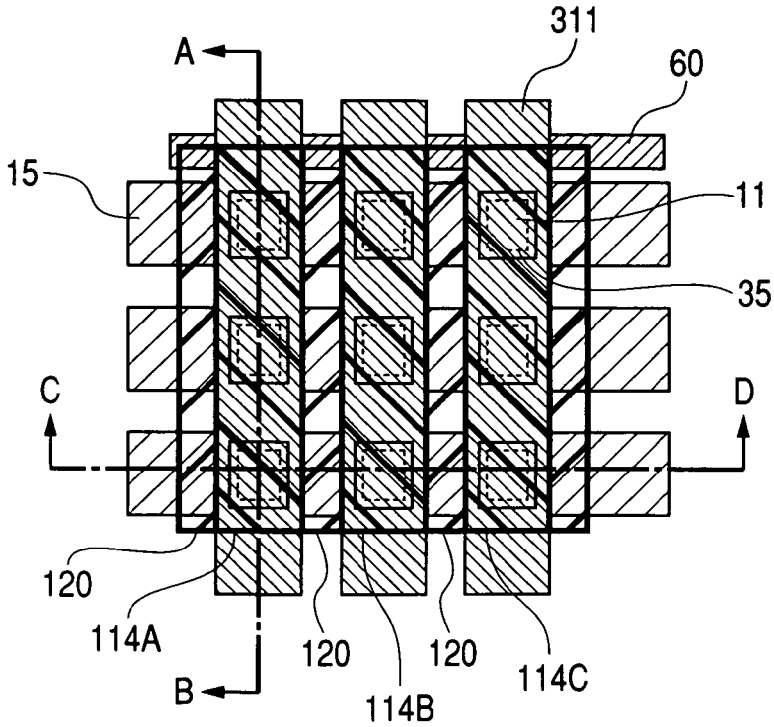
FIG. 10 is a plan view showing a positional relationship between an electron emitter plate and a phosphor plate in the first embodiment of the invention.

FIG. 9 is a plan view showing a constitution for a portion of a matrix of thin-film electron emitters of an electron emitter plate in the preferred embodiment and FIG. 10 is a plan view showing a positional relationship between an electron emitter plate and a phosphor plate in this embodiment.

Figure 11A:
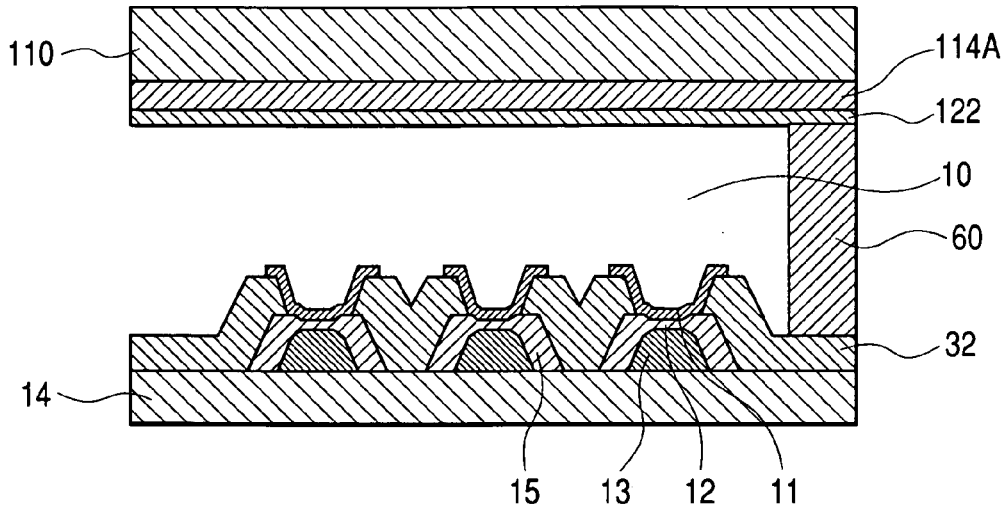
FIG. 11 is a cross sectional view for a main portion showing a constitution of an display apparatus in the first embodiment of the invention.
Figure 11B:
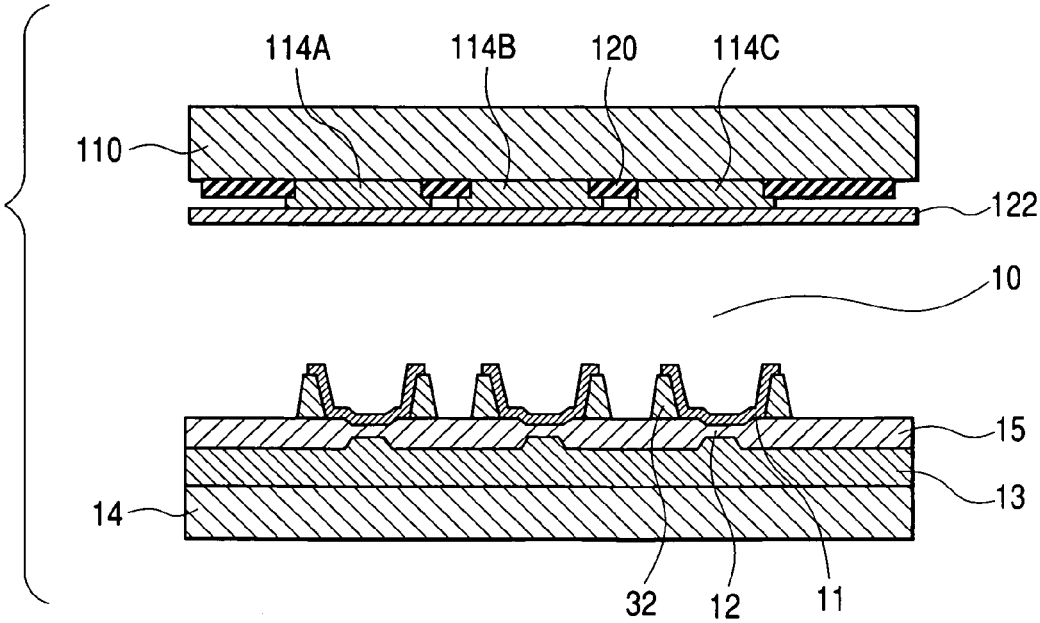

FIGS. 11A and 11B are cross sectional views for a main portion showing a constitution of an display apparatus in this embodiment in which FIG. 11A is a cross sectional view taken along line A-B shown in FIG. 9 and FIG. 10, and FIG. 11B is a cross sectional view taken along line C-D shown in FIG. 9 and FIG. 10. However, in FIG. 9 and FIG. 10, a substrate 14 is not illustrated.

Further, in FIG. 11, reduction of scale in the direction of the height is not to scale. That is, a base electrode 13 or an top electrode bus line 32 has a thickness of several micrometers or less but distance between the substrate 14 and the substrate 110 is about 1 to 3 mm length.

Further, in the explanation for the structure of the display apparatus, while description is to be made with reference to the drawing of a matrix of electron emitters in 3 rows×3 columns, the views show a portion of a matrix of electron emitters comprising a large number of rows and columns. In a typical display panel, the number of rows and columns are: hundreds to thousands of rows and thousands of columns.

In FIG. 9 and FIG. 11, a thin-film electron emitter is formed at an intersection between a base electrode 13 (functioning as scanning line) and an top electrode bus line 32 (function as data line). The thin-film electron emitter has a structure formed by stacking an top electrode 11, a tunnel insulator 12, and a base electrode 13. The top electrode 11 is connected with the top electrode bus line 32.

When a voltage to provide the top electrode 11 with positive polarity is applied between the top electrode 11 and the base electrode 13, electrons are accelerated in the tunnel insulator 12 to generate hot electrons, which are emitted by way of the top electrodes 11 into vacuum. Further, in FIG. 9, a region 35 surrounded with a dotted line shows an electron emitting region (electron emitter element in the invention).

The electron emitting region 35 is a place defined by the tunnel insulator 12 and electrons are emitted from the inside the region into vacuum.

Since the electron emitting region 35 is covered with the top electrode 11 and does not appear in the plan view, it is illustrated by the dotted line.

A phosphor plate in this embodiment comprises a black matrix 120 formed on a substrate 110 made of sodalime glass or the like, phosphors (114A-114C) of red (R)—green (G)—blue (B) and a metal back film 122 (electron acceleration electrode) formed on them.

Further, the distance between the substrate 110 and the substrate 14 was set to about 1 to 3 mm.

A spacer 60 is inserted in order to prevent fracture of the display panel caused by the external pressure of atmospheric air when the inside of the display panel is evacuated.

Accordingly, in a case of manufacturing a display apparatus having a display area of about 4 cm width×9 cm length or less by using glass of 3 mm thickness for the substrate 14 and the substrate 110, it is not required to insert the spacer 60 because it can withstand the atmospheric pressure by the mechanical strength of the substrate 110 and the substrate 14 per se.

The spacer 60, for example, has a rectangular parallelepiped shape as shown in FIG. 10. Although posts for the spacer 60 are disposed on every three lines in the drawing, the number of the posts (density of arrangement) may be decreased within a range of durable mechanical strength.

As the spacers 60, supports made of glass or ceramic in the shape of plate or post are arranged side by side.

The sealed display panel is evacuated to a vacuum degree of about $1\times10^{-7}$ Torr and sealed.

For keeping the vacuum at a high degree in the display panel, a getter film is formed for a getter material is formed or a getter material is activated at a predetermined position (not illustrated) in the display panel just after the sealing. Method of manufacturing display panels of the constitutions shown in FIG. 9, FIG. 10 and FIG. 11 are disclosed, for example, JP-A No. 162927/2002 by the present applicant.

Figure 12:
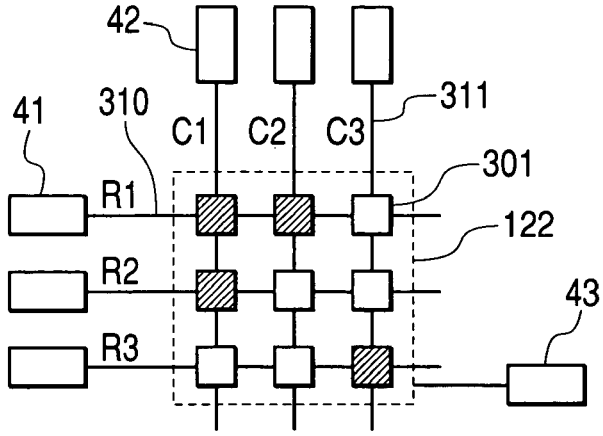
FIG. 12 is a wiring diagram showing the state of connecting driving circuits to a display panel in preferred embodiment 1 of the invention.

FIG. 12 is a wiring diagram showing the state of connecting driving circuits to the display panel of this embodiment.

Row electrodes 310 (identical with base electrode 13 in this embodiment) are connected with electrode driving circuits 41, and column electrodes 311 (identical with top electrode bus lines 32 in this embodiment) are connected to column electrode driving circuits 42.

Each of the driving circuits (41, 42) and the electron emitter plates are connected, for example, by press bonding a tape carrier package with anisotropic conductive films or by chip-on-glass of mounting a semiconductor chip constituting each of the driving circuits (41, 42) directly on the substrate 14 of the electron emitter.

An acceleration voltage of about 3 to 6 kV is continuously applied from an acceleration voltage source 43 to the metal back film 122.

FIG. 1 is a timing chart showing entire images of an example for a waveform of a driving voltage outputted from each of driving circuits shown in FIG. 12.

In the chart, dotted lines mean a high impedance output. Actually, the output impedance may be about 1 to 10 MΩ and it is set to 5 MΩ in this embodiment.

Scanning pulses 750 are applied successively to the row electrodes 310 (scanning electrodes). Data pulses 760 are applied to the column electrodes 311. A sufficient voltage is applied between the top electrode 11 and the base electrode 13 in the pixel to which the scanning pulse 750 and the data pulse 760 are applied at the same time, and electrons are emitted. The electrons are accelerated by acceleration voltage applied to the acceleration electrode 122 on the phosphor plate, and then the electrons collide against the phosphor plate 114 to excite the phosphor and emit light therefrom.

Images are displayed on the display panel by scanning all the scanning electrodes 310.

An reverse pulse 755 is applied to the row electrode 310 once in 1 field period of the image signal.

By applying a voltage (reverse pulse) having a polarity opposite to that at the time of electron emission, the life characteristics of the thin film electron emitters can be improved. When the reverse pulse 755 is applied in the vertical blanking period of the video signal, favorable conformity to video signal is obtained.

Figure 13:
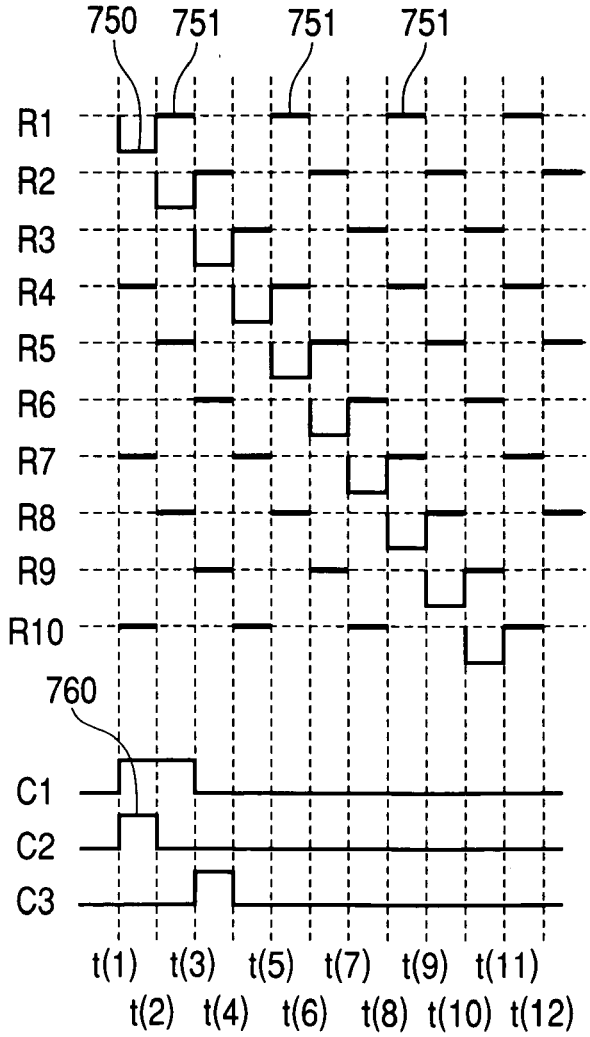
FIG. 13 is a chart showing a driving waveform in the first embodiment of the invention.

FIG. 13 is a detailed view for the timing chart of FIG. 1.

At time t(1), the scanning pulse 750 is applied to a row electrode 310 R1 to render the electrode into the selected state. At the same time, when the data pulse 760 is applied to column electrodes 311 C1, C2, phosphors of pixels (R1, C1) and (R1, C2) emit light.

At time t(2), the scanning pulse 750 is applied to the row electrode 310 R2 to set the electrode into the selected state. When the data pulse 760 is applied to the column electrode 311 C1 at the same time, the phosphor of the pixel (R2, C1) emits light.

As described above, when a voltage waveform is applied in FIG. 13, pixels in the hatched portions in FIG. 12 emit light. Any of desired pixels can emit light by changing the waveform of the data pulse 760. In FIG. 13, dotted portions in the waveform of a voltage applied to the row electrode 310 are at a high impedance state. At time t(2), the scanning pulse 750 is applied to the row electrode 310 R2 and, in this period, the adjacent row electrode 310 R1 is in the non-selected state at the low impedance state 751. The non-selected state at the low impedance state means a state in which the output impedance of the driving circuit is set lower than at the high impedance state and a non-selected state, that is, a state not applying the scanning pulse 750 in this embodiment.

At time t(5) and time t(8), the row electrode 310 R1 is again set to in the non-selected state at the low impedance state 751.

As can be seen from FIG. 13, at time t(8), for example, the number $n_1$ of the row electrodes in the selected state by the application of the scanning pulse 750 is one (row electrode R8). On the other hand, the number of the non-selected scanning lines at the low impedance state is three (row electrodes R1, R4 and R7) which is not less than $n_1 \times 2$.

Since the row electrode R8 applied with the scanning pulse 750 is also at the low impedance state, the number $n_0$ for the row electrodes at the low impedance state is four. This corresponds to no in the equation (4). Usually, since the number of the row electrodes N is about 500 to 1,000, $b=n_0/N$ is about 0.6% to 0.3%. Accordingly, as calculated according to the equation (4), the dissipation power caused by setting the non-selected state at the low impedance state is sufficiently small.

Second Embodiment

A second embodiment of the invention is to be described with reference to FIG. 14, FIG. 15, FIG. 16 and FIG. 17. An display apparatus of a second embodiment 2 according to the invention is constituted by using a display panel in which a luminance modulation element for each dot is formed by the combination of a matrix of thin-film electron emitters as an electron emitting emitter and a phosphor and connecting driving circuits to row electrodes and column electrodes of the display panel.

Figure 14:
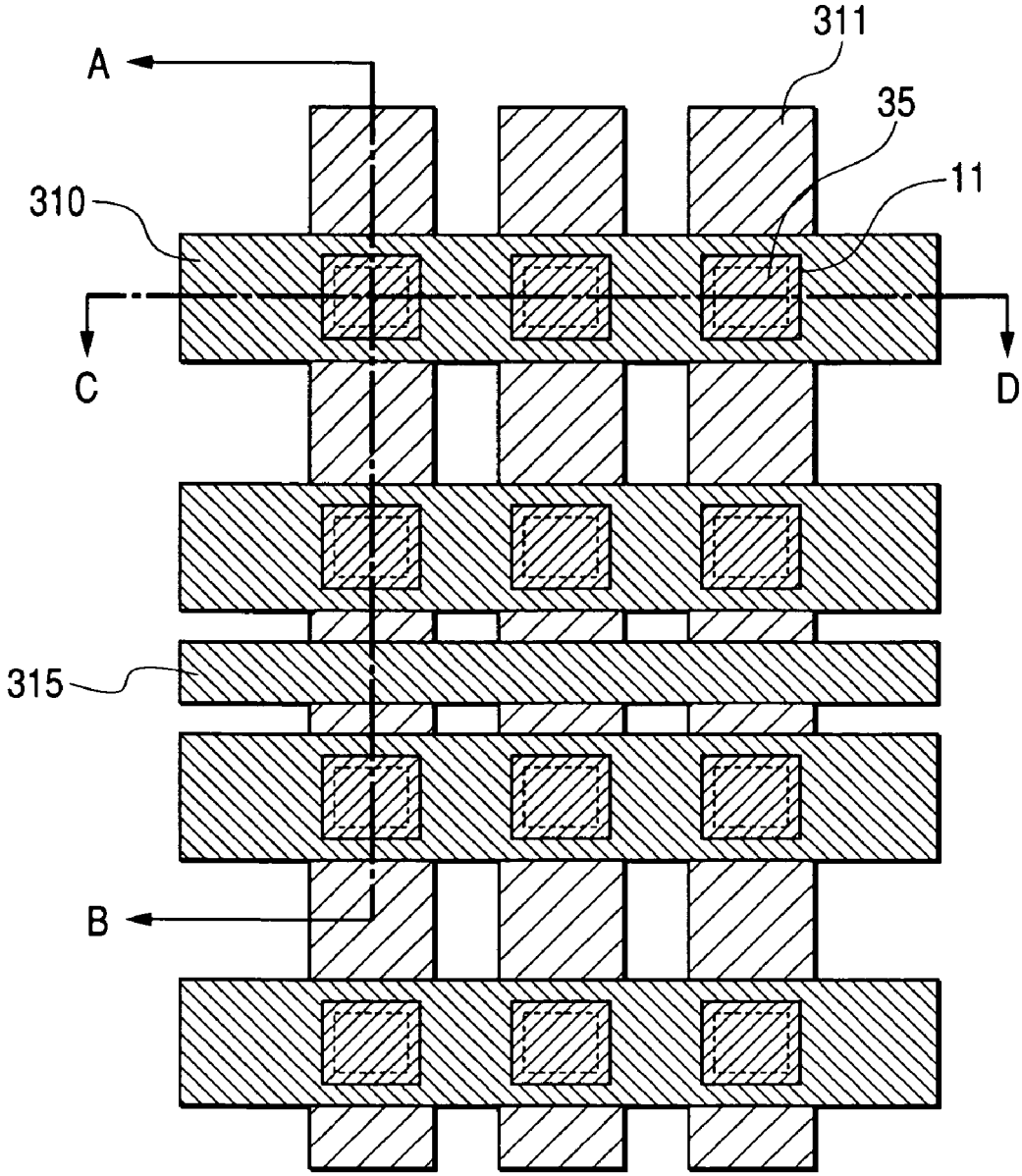
FIG. 14 is a plan view showing a constitution for a portion of a thin-film electron emitter matrix of an electron emitter plate in a second embodiment of the invention.
Figure 15A:
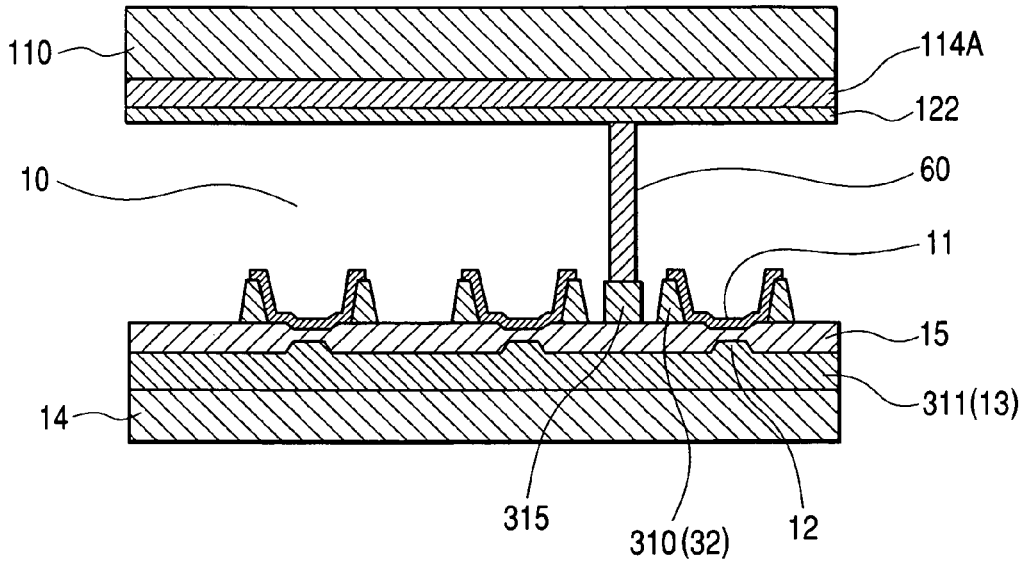
FIG. 15A and FIG. 15B are cross sectional views for a main portion showing a constitution of an display apparatus in the second embodiment of the invention.
Figure 15B:
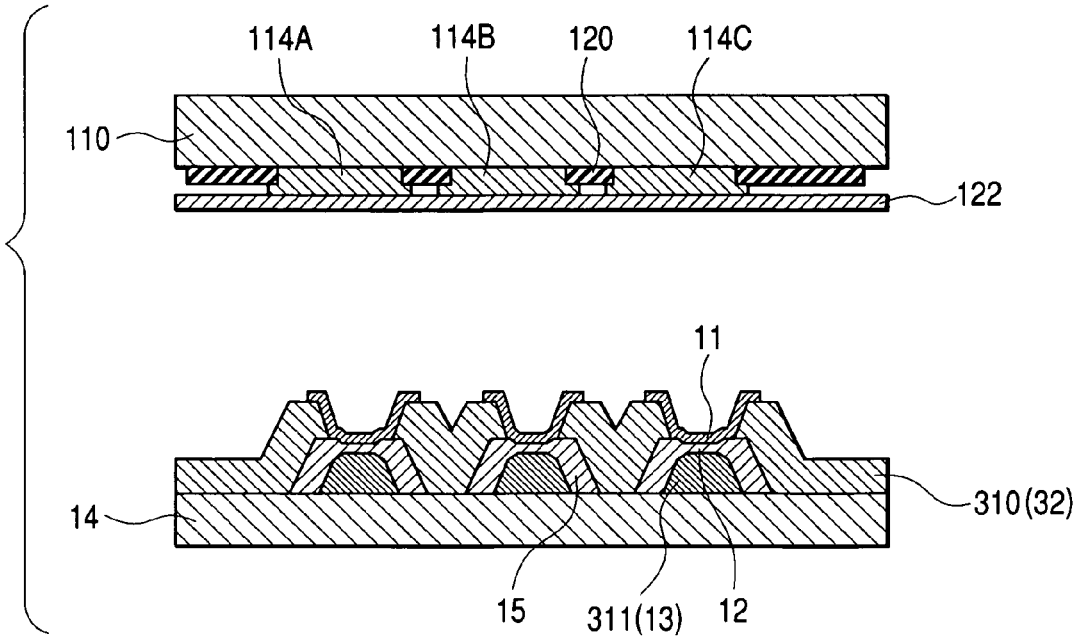
Figure 16:
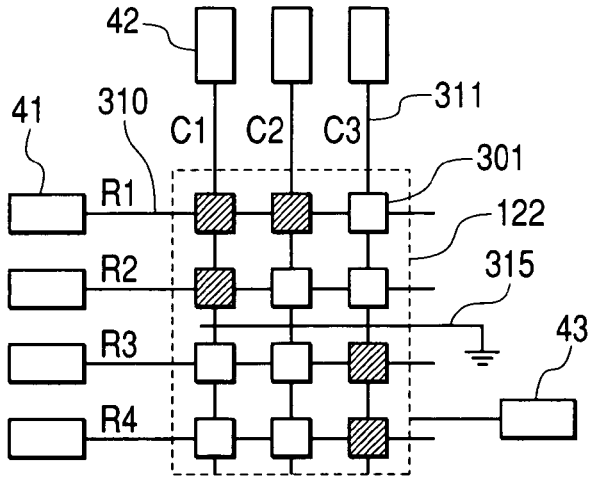
FIG. 16 is a wiring diagram showing the state of connecting driving circuits to a display panel in the second embodiment of the invention.

FIG. 14 shows a plan view of a cathode plate in a display panel constituting the display apparatus of a second embodiment. FIG. 15 and FIG. 16 are cross sectional views of a display panel constituting the display apparatus of Embodiment 2. The cross section A-B shown in FIG. 14 corresponds to FIG. 15A and the cross section C-D shown in FIG. 14 corresponds to FIG. 15B. In this embodiment, a thin-film electron emitter is formed at the intersection between the row electrode 310 (identical with the top electrode bus line 32) and the column electrode 311 (identical with the base electrode 13). In FIG. 14, electrons are emitted from an electron emitting region 35. Emitted electrons are accelerated by a voltage applied to a metal back film 122 and then irradiated to phosphors 114A, 114B and 114C to excite the phosphors and emit light therefrom.

While a 4×3 matrix is illustrated in FIG. 14, FIG. 15 and FIG. 16, the number of rows is from hundreds to thousands and the number of columns is thousands in an actual display apparatus. The figures show a portion thereof.

As shown in FIG. 14 and FIG. 15A, a spacer electrode 315 is disposed between the second row electrode 310 and the third row electrode 310. The spacer electrode 315 is set to a ground potential. A spacer 60 is disposed on the spacer electrode 315. The spacer 60 is provided with a conductivity of an appropriate resistance value. The upper end of the spacer 60 is connected to the metal back film 122 and the lower end is connected to the spacer electrode 315. Accordingly, the distribution of the electric field near the spacer 60 is made uniform between the phosphor plate 110 and the substrate 14. Further, in a case where electrons are irradiated to the spacer 60 to charge the spacer, charges are eliminated because electric charges charged in the spacer flow to the metal back film 112 or the spacer electrode 315. In this way, the distribution of the electric field near the spacer 60 is kept uniform to prevent adverse effect such as distortion of the electron beam trajectories.

The number of the spacers differs depending on the thickness of the substrate used and the pitch of the electrodes. In this embodiment, the spacer is disposed about by one for 40 row electrodes.

FIG. 16 shows wirings between the display panel and the driving circuit in this embodiment. The row electrodes 310 is connected to row electrode driving circuits 41 respectively and the column electrodes 311 are connected with the column electrode driving circuits 42 respectively. The spacer electrode 315 may be set at a substantially identical potential with that for the row electrode 310 or the column electrode 311. In this embodiment, it is set to the ground potential. The metal back film 122 is connected with an acceleration voltage source 43.

Figure 17:
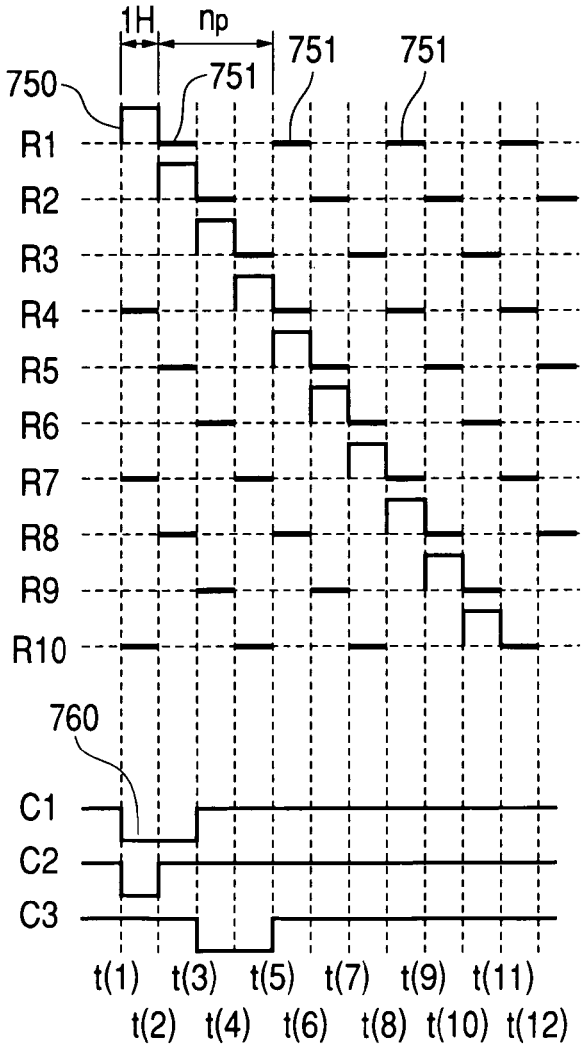
FIG. 17 is a chart showing a driving waveform in the second embodiment of the invention.

FIG. 17 shows output voltage waveforms (R1, R2, . . . ) of the row electrode driving circuits 41 and output voltage waveforms (C1, C2, . . . ) of the column electrode driving circuits 42. In the chart, dotted lines show that the output of the row electrode driving circuit 41 is at a high impedance state. In this embodiment, impedance at the high impedance state is set to 5 MΩ.

At time t(1), a scanning pulse 750 at a positive voltage is applied to the row electrode 310. R. In this embodiment, the amplitude $V_{scan}$ of the scanning pulse is set to +5 V. At the same time, data pulses 760 at a negative voltage are applied to the row electrodes 311 C1, C2. The amplitude $V_{data}$ of the data pulse is set to −3 V. Then, since the scanning pulse and the data pulse are applied being superposed at dot (1, 1) and (1, 2), a voltage of 8 V is applied to the thin-film electron emitter to cause electron emission. Emitted electrons are accelerated by the metal back film 122 and then collide against the phosphor 114 and excite the phosphor to emit light.

At time t(2), the scanning pulse 750 is applied to the row electrode R2. At the same time, the data pulse 760 is applied to the column electrode 311 C1. Then, the dot (2, 1) emits light. Further, at time t(2), the row electrode R1 is set to the non-selected voltage at a low impedance state. This was set to 0 V in this embodiment.

By combining the scanning pulse and the data pulse as described above, any of desired dots can emit light. By the driving waveform shown in FIG. 17, the dots in the hatched portion in FIG. 16 emit light. This is a standard line-sequential scanning operation.

An image is displayed when all the row electrodes (that is, scanning lines) are scanned. This is referred to as a 1-field period. Moving images are displayed by repeating the operation.

Figure 25:
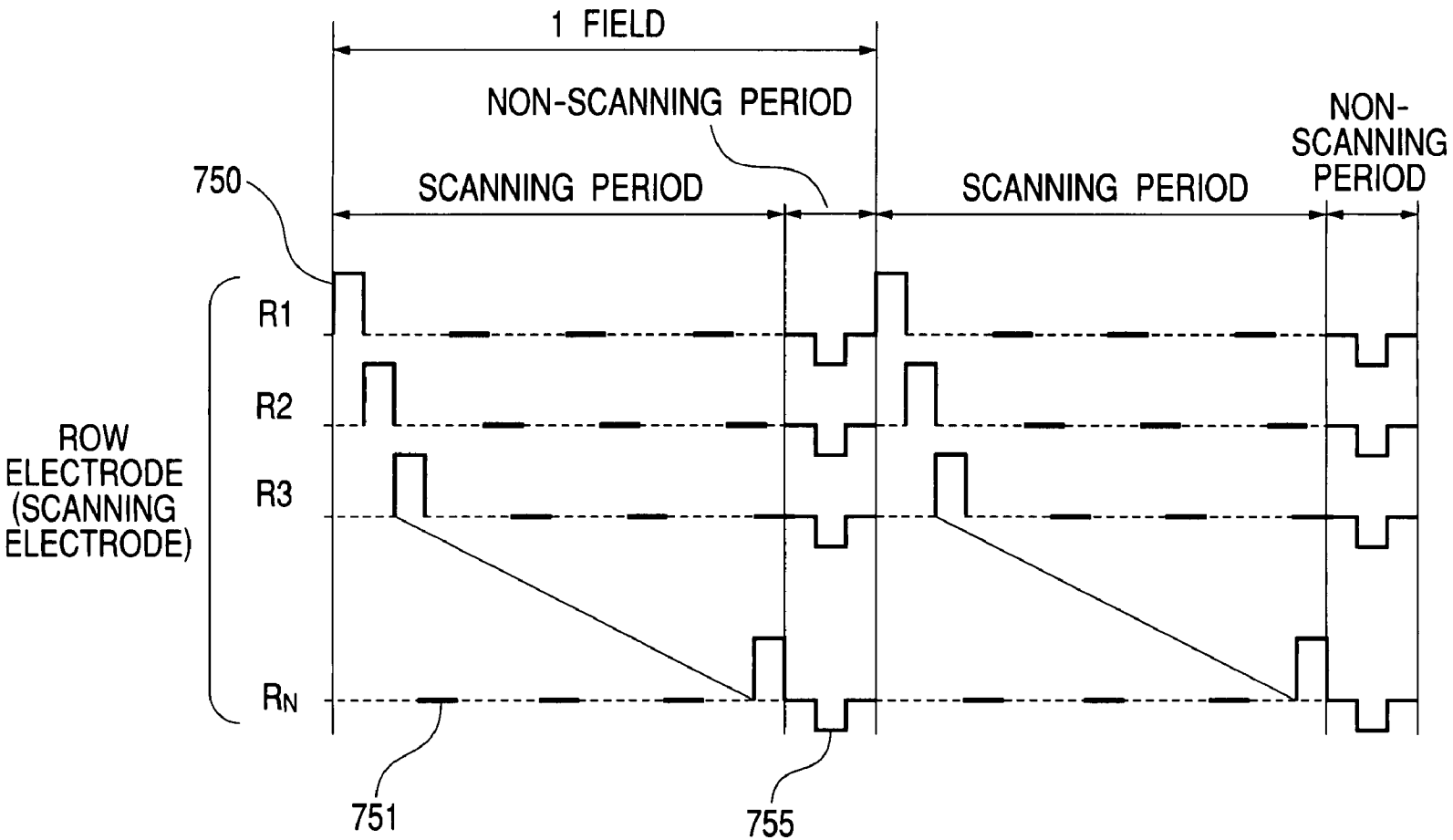
FIG. 25 is a voltage waveform chart showing the definition for a scanning period and a non-scanning period in the present specification.

The 1-field period is divided into a "scanning period", during which scanning pulses 750 are successively applied to scanning lines, and a "non-scanning period", during which the scanning pulse are applied to none of the scanning lines (FIG. 25). As shown in FIG. 25, "scanning period" defined in the present specification means a period in which a scanning pulse is applied to any of the scanning lines. When the non-scanning period is corresponded to the blanking period of the video signal, it has good matching with the video signal. In this embodiment, an reverse pulse 755 is applied during the non-scanning period. As described above, since the reverse pulse is at a voltage of a polarity reverse to that causing electron emission, it does not cause electron emission and does not contribute to light emission. However, this contributes to the extension of life of the thin-film electron emitter.

The period in which the scanning pulse 750 is not applied during the scanning period (for example, period after time t(2) in the case of the row electrode R1 in FIG. 17) is a non-selected period. After applying the scanning pulse 750, it is once set to the non-selected state at the low impedance state 751 (time t(2)) and then set to the high impedance state (period from time t(3) to time t(5) in the dotted line shown in FIG. 17). Then, after time t(5), it is set to the non-selected state at the low impedance state 751. Then, after time t(6), it is again set to the high impedance state. As described above, in the non-selected period, non-selected state at the high impedance state and at the low impedance state are repeated appropriately. This can decrease the dissipation power and eliminate crosstalk as described above.

A method of setting the number of the scanning lines at the low impedance state to $n_0$ at any time in the scanning period is to be described with reference to FIG. 17. The scanning period means a period obtained by removing blanking period from the 1-field period. In other words, the scanning period corresponds to the period of successively applying scanning pulses.

In the following description, the time slot of the selected period for 1 line is assumed as 1H and the time slot is indicated on the unit of 1H (refer to FIG. 17).

After applying a scanning pulse 750 to the first row electrode R1, low electrode R1 is set to the non-selected state at the low impedance state 751 for 1H period. Subsequently, the electrode is set to the non-selected state at the low impedance state 751 on every $n_p$(H). The waveform for the second line R2 is formed by shifting the waveform of the first line R1 by the time for 1H. The waveforms for the third line R3 and the following lines are obtained by shifting the waveform of the respective preceding line by a time of 1H. In this constitution, at any time in the scanning period, the number of row electrodes in the non-selected state 751 at low impedance is $N/n_p$. Here, N represents the number of row electrodes. When combined with the number $n_1$ for the row electrodes in the selected state, the number $n_0$ for the row electrodes at the low impedance state is represented by equation (7) as:

$$n_0=(N/n_p)+n_1 \tag{7}$$

Accordingly, the following equation is established for the condition between the ratio of the row electrodes at the low impedance state (low impedance ratio) $b=n_0/N$ and $n_p$.

$$b=\frac{1}{n_p}+\frac{n_1}{N} \tag{8}$$

Figure 8:
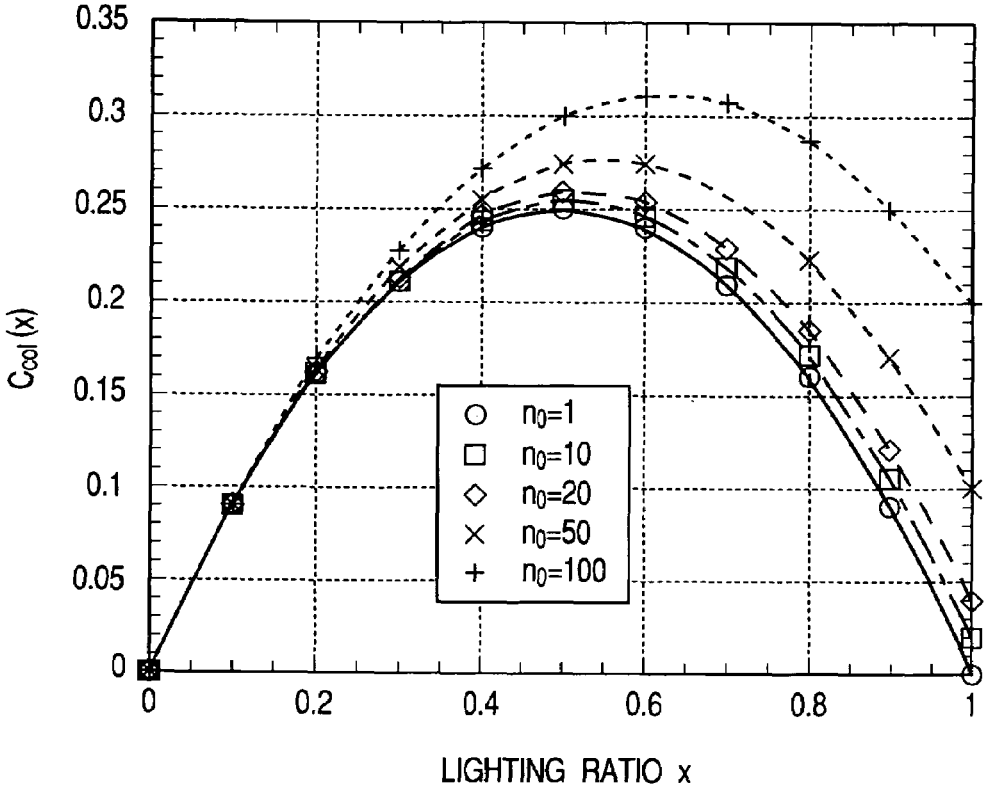
FIG. 8 is a graph showing a relation between a lighting ratio and a load capacitance in an display apparatus according to the invention.

In FIG. 17, it is assumed as $n_p$=3[H] in FIG. 17 for easy recognition of the set pattern for the non-selected state at the low impedance state 751. In an actual case, a typical example is: $n_p$=20 [H], N=480, $n_1$=1; and in this case, b=5.2%. Such a small value of b is preferred because the increment in the dissipation power can be suppressed to a small level as shown in FIG. 8.

The display apparatus of using the combination of the electron emission element and the phosphor as the luminance modulation element involves a problem of sometimes inducing abnormal discharge such as arc discharge by high voltage applied to the phosphor when the electrode in contact with the vacuum surface is set to a floating potential. This is because electric charges occurs to the electrode in the floating state by electric charges emitted in vacuum. In this embodiment, the row electrode 310 is in contact with the vacuum surface. According to the driving system of the invention, since the row electrodes 310 are set to the low impedance state at appropriate timings during 1 field, this can prevent occurrence of charging of static electricity and eliminate occurrence of abnormal discharge. For example, in the example shown in FIG. 17, the row electrodes 310 are set to the low impedance state on every $n_p$[H]. As described above, the invention is effective particularly for a display apparatus of using the combination of the electron emission element and the phosphor as the luminance modulation element.

A preferred range for the impedance value at the high impedance state in the invention is set as described below.

Figure 18:
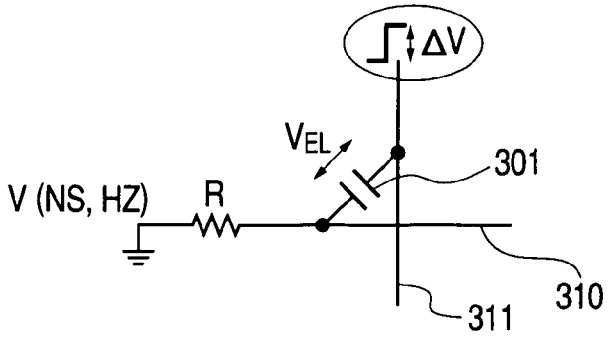
FIG. 18 is a schematic view for a portion of a luminance modulation element and an electrode in the invention.

FIG. 18 is a schematic view for a portion of a luminance modulation element 301, a row electrode 310 and a column electrode 311 taken from a display panel. The row electrode 310 corresponds to the scanning line in the display panel. Resistance R represents an output impedance of the electrode driving circuit. In this embodiment, the luminance modulation element 301 comprises a combination of a thin-film electron emitter and a phosphor.

It is considered here a case where voltage on the row electrode 311 changes by amplitude ΔV. Since, the current supplied from the row electrode driving circuit is restricted by the resistor R, the amount of change $\Delta V_{EL}$ of the voltage $V_{EL}$ between the terminals of the luminance modulation element changes in accordance with the following equation (9):

$$\Delta V_{EL}=\Delta V(1-\exp[-t/\tau]) \tag{9}$$

where $\tau=RC_L$ and $C_L$ is a load capacitance of the row electrode. That is, this is a value for the sum of the capacitance of all luminance modulation elements, among those, connected to one row electrode, that are applied with $\Delta V$ pulse, and an inter-wiring stray capacitance.

The selected time slot for one scanning line is determined or assumed as 1H. In a case where $\tau$=5H, even when a voltage change $\Delta V$ is given to the row electrode, the amount of change $\Delta V_{EL}$ of the voltage across the element after 1H is only $0.18\times\Delta V$. Since the dissipation power to be discussed in the invention is in proportion to the square of $(\Delta V_{EL})$, it can be seen that a sufficient power reduction effect can be obtained at $\tau$=5H.

That is, the effect of the invention can be attained by setting the value for the impedance R such that $\tau\geqq 5H$. This is the definition for the high impedance state in the invention.

Figure 19:
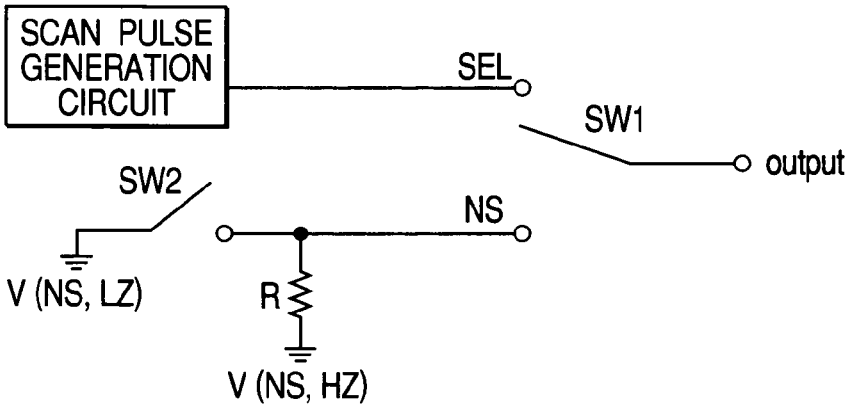
FIG. 19 is a view showing an example of a row electrode driving circuit in the second embodiment of the invention.

FIG. 19 shows an example for the constitution of the row electrode driving circuit 41. The output is connected to each row electrode 310. In a case of selecting a certain row electrode, when a switching circuit SW1 is connected on the selection (SEL) side, a scanning pulse outputted from a scan pulse generation circuit is applied to the row electrode, to set the electrode to the selected state. On the other hand, in a case of setting the row electrode into the non-selected state, the switching circuit SW1 is connected to the non-selected (NS) side. In a case of disconnecting the switching circuit SW2, a high impedance state in which the output impedance is defined by the resistance R is obtained. On the contrary, in a case of connecting the switching circuit SW2, the row electrode is set to the non-selected state at the low impedance state. In FIG. 19, V(NS, LZ) shows a potential in the non-selected state at the low impedance state, and V(NS, HZ) shows the potential in the non-selected state at the high impedance state.

In this embodiment, both V(NS, LZ) and V(NS, HZ) are set to the ground potential.

Figure 20:
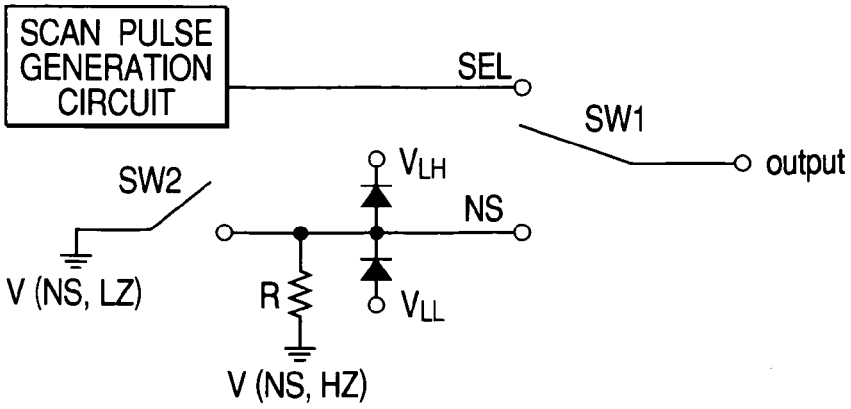
FIG. 20 is a view showing another example of a row electrode driving circuit in the second embodiment of the invention.

FIG. 20 shows an example of another constitution for the row electrode driving circuit 41. In this embodiment, a voltage limiter circuit is attached in addition to the constitution in FIG. 19. That is, for restricting the potential fluctuation on the row electrode at the high impedance state to a predetermined range, it is connected by way of diodes to the high level limiter potential $V_{LH}$ and low level limiter potential $V_{LL}$. With the circuit constitution, the potential fluctuation on the row electrode at the high impedance state is restricted to the range between $V_{LH}$ and $V_{LL}$.

In this embodiment, it is set as $V_{LH}$=1 V, and $V_{LL}$=−5 V. The absolute values are different between the setting values for $V_{LH}$ and $V_{LL}$ because the luminance modulation element constituting the display panel is a unipolar device. That is, in this embodiment, since the fluctuation to the positive potential on the row electrode is in the forward direction for the luminance modulation element, it may possibly result in display crosstalk, so that the potential fluctuation allowance is small. On the other hand, since the fluctuation to the negative potential in the row electrode is that of reverse polarity, this does not cause display crosstalk. Accordingly, the potential fluctuation allowance on the side of the negative potential is large.

As will be described later, when the voltage limiter circuit operates, since the scanning line thereof is rendered to a low impedance, the power reduction effect is decreased temporarily. Accordingly, for obtaining the power reduction effect to the utmost degree, it is preferred to increase the allowable voltage range for the voltage limiter as large as possible so as not to operate the limiter. In the invention, this is attained by setting an allowable voltage larger in the direction of reverse polarity by utilizing the unipolar characteristic of the luminance modulation element.

Alternatively, the voltage limiter may be set only on the side of the forward polarity voltage of the luminance modulation element while eliminating the limiter on the side of the reverse polarity voltage. For example, referring to this embodiment, the limiter circuit may be disposed only on the side of $V_{LH}$ while eliminating the limiter circuit on the side of $V_{LL}$ in FIG. 20.

Display images can be stabilized further by using the voltage limiter circuit as described above.

When the induced voltage on the row electrode exceeds a limiter voltage and the limiter circuit operates, the row electrode turns to the low impedance state. As an example in FIG. 17, it is considered a case that the induced voltage for the row electrode 310 R1 exceeds a limiter voltage at time t(6). Then, since the row electrode 310 R1 turns to the low impedance state by way of the limiter circuit, the power reduction effect is decreased temporarily. However, at time t(8), since it is set to the non-selected state 751 at low impedance, it is turned-back within the range of the limiter voltage. Accordingly, after the time t(9), it again returns to the high impedance state.

Third Embodiment

A third embodiment of the invention is to be described with reference to FIG. 21, FIG. 22, FIG. 23, and FIG. 24. An display apparatus of a third embodiment according to the invention is constituted by using a display panel in which a luminance modulation element for each dot is formed by the combination of a matrix of thin-film electron emitters as an electron emitting emitter and a phosphor and connecting driving circuits to row electrodes and column electrodes of the display panel.

Figure 21:
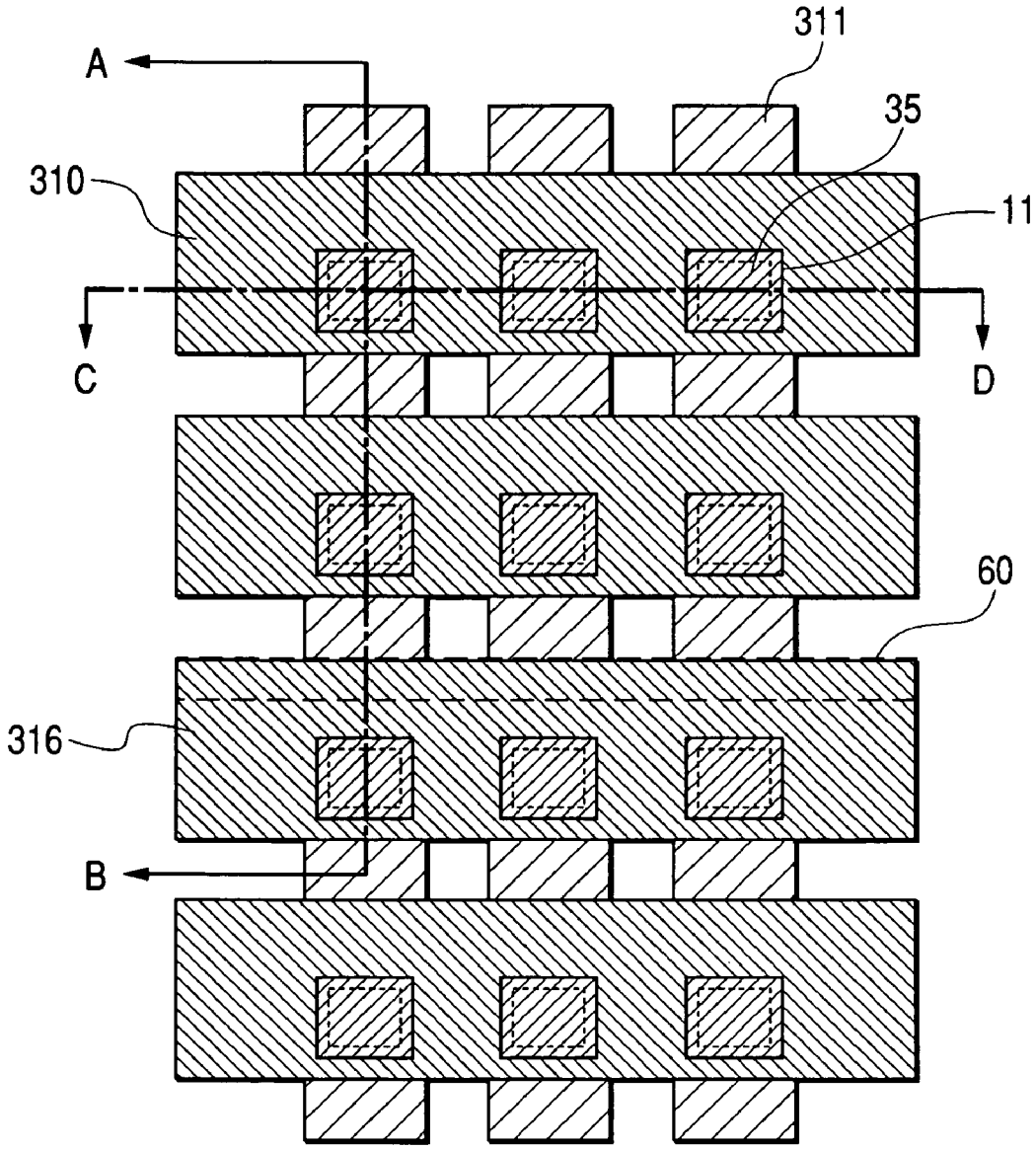
FIG. 21 is a plan view showing a constitution for a portion of a thin-film electron emitter matrix of an electron emitter plate in a third embodiment of the invention.
Figure 22A:
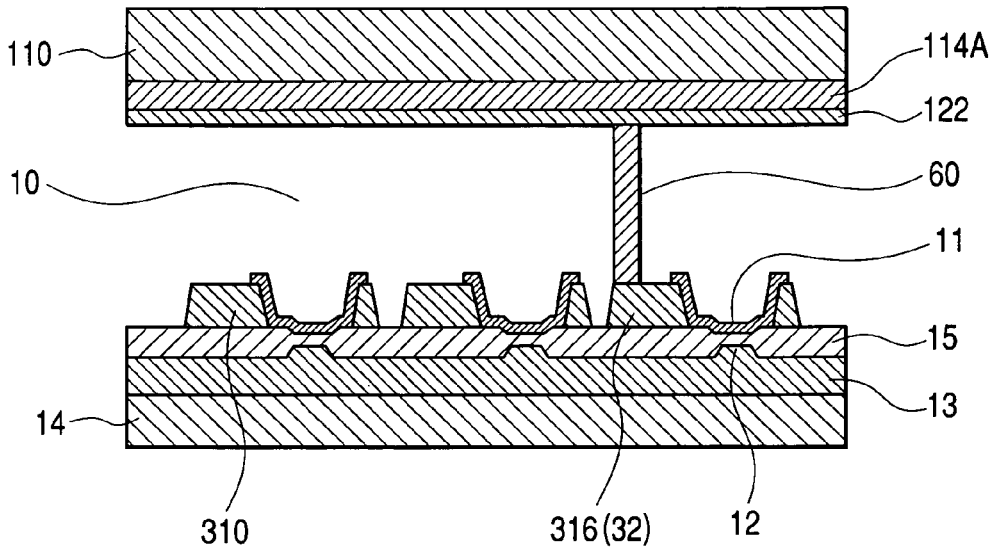
FIG. 22A and FIG. 22B are cross sectional views for a main portion showing a constitution of an display apparatus in the third embodiment of the invention.
Figure 22B:
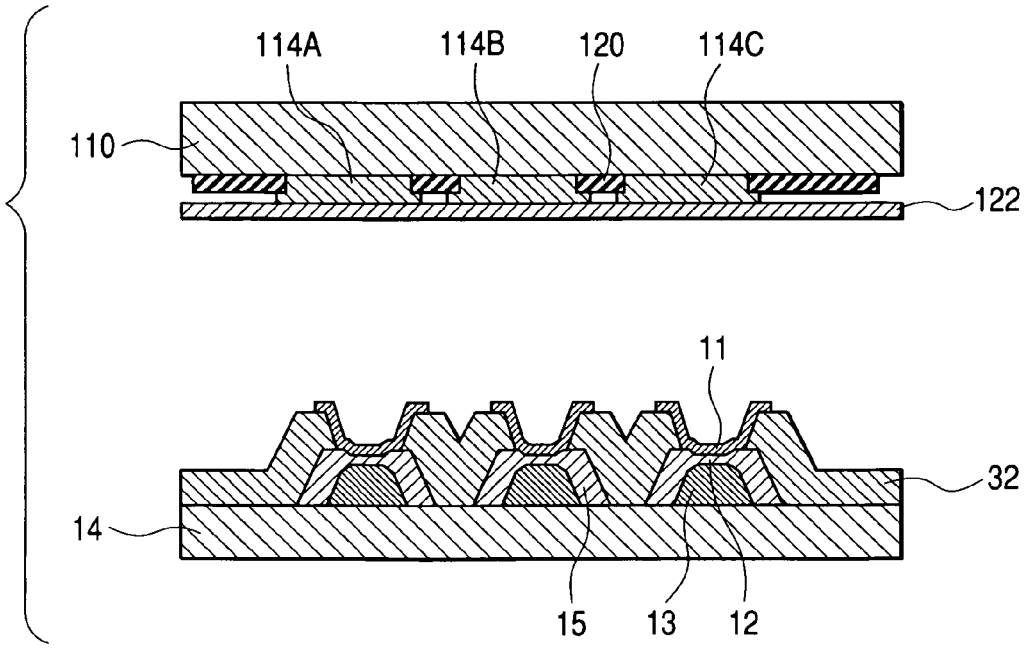

In this embodiment, some of row electrodes also serve as the spacer electrode 315. The row electrode serving also as the spacer electrode is referred to as a spacer disposed row electrode 316. That is, as shown in FIG. 21 and FIG. 22, a spacer 60 is disposed on a spacer disposed row electrode 316. The shape and the constitution of the spacer disposed row electrode 316 may be identical with those of other row electrodes 310. In FIG. 21, the spacer 60 is disposed to the portion shown by dotted lines.

Like in the second embodiment, charging on the spacer 60 is prevented by applying the spacer 60 with appropriate electroconductivity.

The display panel described in this embodiment can be manufactured by same method as in the second embodiment.

Figure 23:
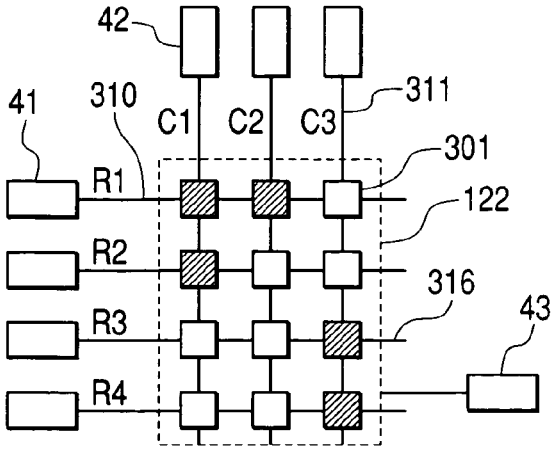
FIG. 23 is a wiring diagram showing the state of connecting driving circuits to a display panel in the third embodiment of the invention.

FIG. 23 is a figure showing a method of wiring the display panel and driving circuits of this embodiment. The spacer disposed electrode 316 is connected to the row electrode driving circuit 41 in the same manner as other row electrodes.

Figure 24:
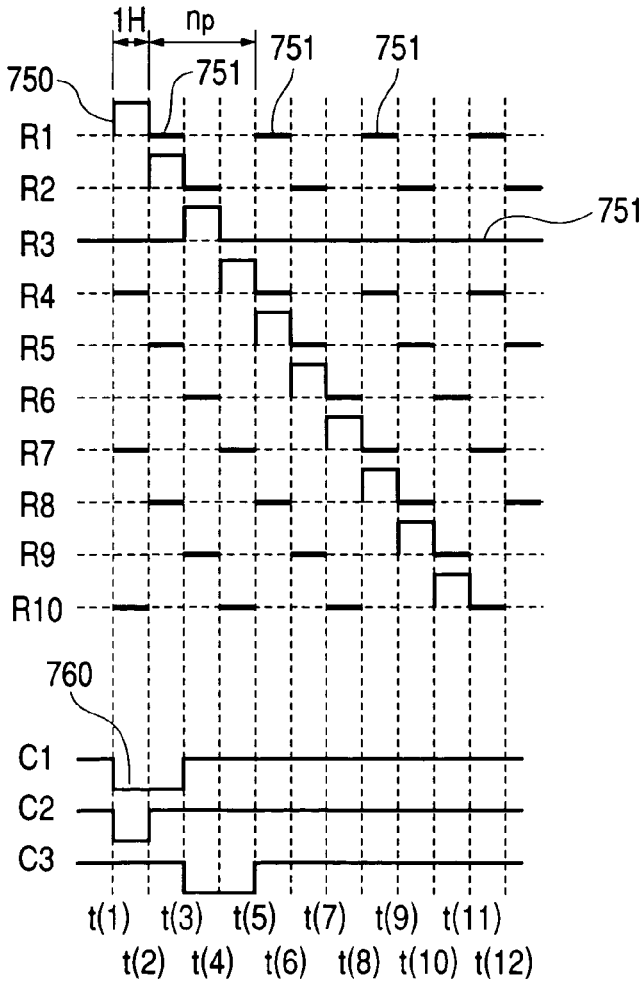
FIG. 24 is a chart showing a driving waveform in the third embodiment of the invention.

FIG. 24 shows output voltage waveforms (R1, R2, . . . ) of the row electrode driving circuit 41 and output voltage waveforms (C1, C2, . . . ) of the column electrode driving circuits 42. In the chart, dotted lines show that the output of the row electrode driving circuit 41 is at a high impedance state. In this embodiment, impedance at the high impedance state is set to 5 MΩ.

In this embodiment, the spacer disposed row electrode 316 (R3) is always set to a low impedance state, that is, either of the non-selected state at the low impedance state 751 or the selected state 750, during image display operation. Since a high voltage is applied to the metal back film 122, a minute leak current flows by way of the spacer 60 provided with an appropriate conductivity to the spacer disposed row electrode 316. With such a constitution, charging on the spacer can be prevented and the electric field near the spacer can be kept uniform.

It may suffice that the spacer 60 has such conductivity as capable of preventing charging on the spacer and slight conductivity may suffice. Accordingly, the resistance value of the spacer is set much higher than the output impedance of the row electrode driving circuit 41. Accordingly, the scanning pulse 750 can be applied also to the spacer disposed row electrode 316.

In the display panel, the number of the spacer disposed row electrodes 316 is set to $n_s$. Then, the number of scanning lines at the low impedance state at any given time during the scanning period is represented by the equation (10):

$$n_0=(N/n_p)+n_1+n_s \tag{10}$$

Symbols N, $n_0$ and $n_1$ have the same meanings as defined above. Accordingly, the following relation (Equation 11) is established for the conditions between the ratio of the row electrodes at the low impedance state (low impedance ratio): $b=n_0/N$, and $n_p$.

$$b=\frac{1}{n_p}+\frac{1}{N}(n_1+n_s) \tag{11}$$

In FIG. 24, it is set as: $n_p=3$[H] for easy recognition of the set pattern for the non-selected state at the low impedance state 751. In an actual case, a typical example is: $n_p=20$[H], N=480, $n_1=1$, $n_s=10$; and in this case, b=7.3%. Such a small value of b is preferred because the increment in the dissipation power can be suppressed to a small level as shown in FIG. 8.

In the foregoings, descriptions have been made to the display apparatus in which the thin-film electron emitter and the phosphor are combined as a luminance modulation element. It will be apparent that the invention is applicable also to an display apparatus using other unipolar luminance modulation element.

What is claimed is:

1. A display apparatus comprising:

plural luminance modulation elements that modulate luminance upon application of a voltage of positive polarity and do not modulate luminance upon application of a voltage of reverse polarity, each of the luminance modulation elements comprising a combination of an electron emission element and a phosphor;

plural scanning electrodes parallel with each other and plural data electrodes parallel with each other, in which each of the luminance modulation elements is disposed at an intersection between the scanning electrode and the data electrode; and first driving means connected to the plural scanning electrodes and outputting scanning pulses, and second driving means connected to the plural data electrodes, wherein, at a certain time point, the scanning electrodes are grouped into those in a selected state applied with a scanning pulse and those other than described above in a non-selected state, the number of the scanning lines in the selected state is $n_1$, the scanning lines in the non-selected state are grouped into non-selected state scanning lines at a high impedance state and non-selected state scanning lines at a low impedance state, the non-selected state scanning lines at the high impedance state are at a higher impedance state than the scanning lines in the selected state, and the non-selected state scanning lines at the low impedance state is in a lower impedance state than the non-selected state scanning lines at the high impedance state, and the number of the non-selected state scanning lines at the low impedance state is $n_1\times2$ or more.

2. A display apparatus according to claim 1, wherein the number of the non-selected state scanning lines at the low impedance state is 10% or less of the number of the scanning electrodes.

3. A display apparatus according to claim 1, wherein the impedance of the non-selected state scanning line at the high impedance state is 1 MΩ or higher.

4. A display apparatus comprising:

plural luminance modulation elements that modulate luminance upon application of a voltage of positive polarity and do not modulate luminance upon application of a voltage of reverse polarity, each of the luminance modulation elements comprising an organic light emitting diode;

plural scanning electrodes parallel with each other and plural data electrodes parallel with each other, in which each of the luminance modulation elements is disposed at an intersection between the scanning electrode and the data electrode; and first driving means connected to the plural scanning electrodes and outputting scanning pulses, and second driving means connected to the plural data electrodes, wherein, at a certain time point, the scanning electrodes are grouped into those in a selected state applied with a scanning pulse and those other than described above in a non-selected state, the number of the scanning lines in the selected state is $n_1$, the scanning lines in the non-selected state are grouped into non-selected state scanning lines at a high impedance state and non-selected state scanning lines at a low impedance state, the non-selected state scanning lines at the high impedance state are at a higher impedance state than the scanning lines in the selected state, and the non-selected state scanning lines at the low impedance state is in a lower impedance state than the non-selected state scanning lines at the high impedance state, and the number of the non-selected state scanning lines at the low impedance state is $n_1\times2$ or more.

5. A display apparatus according to claim 1, wherein the electron emission element comprises a thin film electron emitter having an top electrode, an electron acceleration layer, and a base electrode.

6. A display apparatus according to claim 4, wherein the number of the non-selected state scanning lines at the low impedance state is 10% or less of the number of the scanning electrodes.

7. A display apparatus according to claim 4, wherein the impedance of the non-selected state scanning line at the high impedance state is 1 M Ω or higher.

8. A display apparatus comprising:

plural luminance modulation elements that modulate luminance upon application of a voltage of positive polarity and do not modulate luminance upon application of a voltage of reverse polarity, the luminance modulation elements comprising an organic light emitting diode;

plural scanning electrodes parallel with each other and plural data electrodes parallel with each other; and first driving means connected to the plural scanning electrodes and outputting scanning pulses, and second driving means connected to the plural data electrodes, wherein the scanning electrodes are set to at least three states, namely, a selected state applied with a scanning pulse, a non-selected state at a high impedance state and a non-selected state at a low impedance state, wherein the non-selected state scanning lines at the low impedance state is at a lower impedance state than the non-selected state scanning lines at the high impedance state, and the non-selected state at the low impedance state and the non-selected state at the high impedance state are repeated alternately.

9. A display apparatus according to claim 8, wherein image display operation is conducted by a line sequential scanning operation.

10. A display apparatus according to claim 8, wherein a relation $Z \times C_L > 5 \times H$ is satisfied, in which $C_L$ represents the electrostatic capacitance of the scanning electrode, Z represents the output impedance of the first driving means when the electrode is set to the non-selected state at the high impedance state, and H represents a time slot for the selected period of one scanning line.

11. A display apparatus according to claim 8, wherein the first driving means has a means of providing a low impedance state when the potential on the scanning electrode in the non-selected states is going to exceed a predetermined voltage range and retaining the potential on the scanning electrodes within the predetermined voltage range.

12. A display apparatus according to claim 11, wherein the predetermined voltage range ranges from the first voltage end to the second voltage end, wherein at the first voltage end, the voltage applied to the luminance modulation element is on the side of the positive polarity with the amplitude of V1, and at the second voltage end, the voltage applied to the luminance modulation element is on the side of the reverse polarity with the amplitude of V2, and the absolute value of V2 is larger than that of V1.

13. A display apparatus according to claim 8, wherein the following equation is satisfied:

$$(1/n_p)+(n_1/N) \leqq 0.1$$

where $n_1$ represents the number of the scanning electrodes in the selected state at a time, N represents the number of the scanning electrodes, and $n_p$[H] represents the average repetition period in which the non-selected state at the low impedance state and the non-selected state at the high impedance state are repeated.

14. A display apparatus comprising:

plural luminance modulation elements each comprising an electron emission element and a phosphor;

plural scanning electrodes parallel with each other and plural data electrodes parallel with each other; and first driving means connected to the plural scanning electrodes and outputting scanning pulses, and second driving means connected to the plural data electrodes, wherein the first driving means take at least three states, namely, a selected state of applying scanning pulses, a non-selected state at a high impedance state and a non-selected state at a low impedance state, the non-selected state scanning lines at the low impedance state is at a lower impedance state than the non-selected state scanning lines at the high impedance state, and the non-selected state at the low impedance state and the non-selected state at the high impedance state are repeated alternately.

15. A display apparatus according to claim 14, wherein the image display operation is conducted by a line sequential scanning operation.

16. A display apparatus according to claim 14, wherein a relation $Z \times C_L > 5$ H is satisfied, in which $C_L$ represents the electrostatic capacitance of the scanning electrode, Z represents the output impedance of the first driving means when the electrode is set to the non-selected state at the high impedance state and H represents a time slot for the selected period of one scanning line.

17. A display apparatus according to claim 14, wherein the first driving means has a means of providing a low impedance state when the potential on the scanning electrode in the non-selected states is going to exceed a predetermined voltage range and retaining the potential on the scanning electrodes within the predetermined voltage range.

18. A display apparatus according to claim 17, wherein the predetermined voltage range ranges from the first voltage end to the second voltage end, wherein at the first voltage end, the voltage applied to the luminance modulation element is on the side of the positive polarity for the luminance modulation element with the amplitude of V1, and at the second voltage end, the voltage applied to the luminance modulation element is on the side of the reverse polarity with the amplitude of V2, wherein the absolute value of V2 is larger than that of V1.

19. A display apparatus according to claim 14, wherein the following equation is satisfied:

$$(1/n_p)+(n_1/N) \leqq 0.1$$

where $n_1$ represents the number of the scanning electrodes in the selected state at a time, N represents the number of the scanning electrodes, and $n_p$[H] represents the average repetition period in which the non-selected state at the low impedance state and the non-selected state at the high impedance state are repeated.

20. A display apparatus according to claim 14, wherein the scanning electrode is formed on the side nearer to vacuum than the data electrode.

21. A display apparatus according to claim 14, wherein the scanning electrode is in contact with vacuum.

22. A display apparatus according to claim 14, wherein some of the scanning electrodes are in contact with a spacer, and the scanning electrodes in contact with the spacer are set to the low impedance state during the display operation period.

23. A display apparatus according to claim 14, wherein the following equation is satisfied:

$$(1/n_p)+(n_1+n_s)/N \leqq 0.1$$

where $n_1$ represents the number of the scanning electrodes in the selected state at a time, N represents the number of the scanning electrodes, $n_s$ represents the number of scanning electrodes in contact with spacers, and $n_p$[H] represents the average repetition period in which the non-selected state at the low impedance state and the non-selected state at the high impedance state are repeated.

24. A display apparatus according to claim 14, wherein the electron emission element comprises a thin film electron emitter having an top electrode, an electron acceleration layer, and a base electrode.

* * * * *